United States Patent [19]

Kozuka et al.

[11] Patent Number: 5,028,966

[45] Date of Patent: Jul. 2, 1991

[54] IMAGE-FORMING MACHINE

[75] Inventors: Nobuhiko Kozuka, Suita; Shigeo Koyama, Ibaraki; Eiji Tsutsui, Sanda, all of Japan

[73] Assignee: Mita Industrial Co., Ltd., Osaka, Japan

[21] Appl. No.: 430,339

[22] Filed: Nov. 2, 1989

[30] Foreign Application Priority Data

| | | | |
|---|---|---|---|
| Nov. 10, 1988 | [JP] | Japan | 63-282357 |
| Nov. 11, 1988 | [JP] | Japan | 63-283783 |
| Nov. 11, 1988 | [JP] | Japan | 63-285158 |
| Nov. 11, 1988 | [JP] | Japan | 63-285159 |

[51] Int. Cl.[5] ..... G03G 15/06; G03G 21/00

[52] U.S. Cl. ..... 355/260; 118/657; 355/210; 355/211; 355/298

[58] Field of Search ..... 355/260, 210, 211, 200, 355/296, 298, 299, 305, 251, 253; 118/657, 658, 661

[56] References Cited

U.S. PATENT DOCUMENTS

| | | | |
|---|---|---|---|
| 4,339,196 | 7/1982 | Beck et al. | 355/251 |
| 4,555,173 | 11/1985 | Iseki et al. | 355/200 |
| 4,609,276 | 9/1986 | Mitzutani | 355/210 |
| 4,922,305 | 5/1990 | Agarwal | 355/299 |

FOREIGN PATENT DOCUMENTS

| | | | |
|---|---|---|---|
| 0061859 | 4/1984 | Japan | 355/210 |
| 0008885 | 1/1985 | Japan | 355/298 |
| 0021073 | 2/1985 | Japan | 355/298 |
| 0140264 | 7/1985 | Japan | 355/210 |
| 0164750 | 8/1985 | Japan | 355/210 |
| 0002180 | 1/1986 | Japan | 355/298 |
| 0114275 | 5/1986 | Japan | 355/298 |
| 0088559 | 4/1989 | Japan | 355/210 |

*Primary Examiner*—A. T. Grimley
*Assistant Examiner*—Matthew S. Smith
*Attorney, Agent, or Firm*—Beveridge, DeGrandi & Weilacher

[57] ABSTRACT

An image-forming machine having a main body and a process unit adapted to be detachably mounted on the main body. The process unit includes a first unit having a developing device and a charging corona discharger and a second unit having a rotating drum and a cleaning device. The developing device comprises a magnetic brush mechanism comprised of a hollow cylindrical sleeve and a permanent magnet disposed within the sleeve and a blade adapted to be brought into press contact with the surface of the sleeve and to decrease sufficiently the thickness of the developer layer on the sleeve surface. The cleaning device includes an elastic blade adapted to be brought into press contact with a photosensitive member disposed on the surface of the rotating drum. The toner removed from the surface of the photosensitive member by the action of the elastic blade is recovered into an interior space of the rotating drum.

24 Claims, 16 Drawing Sheets

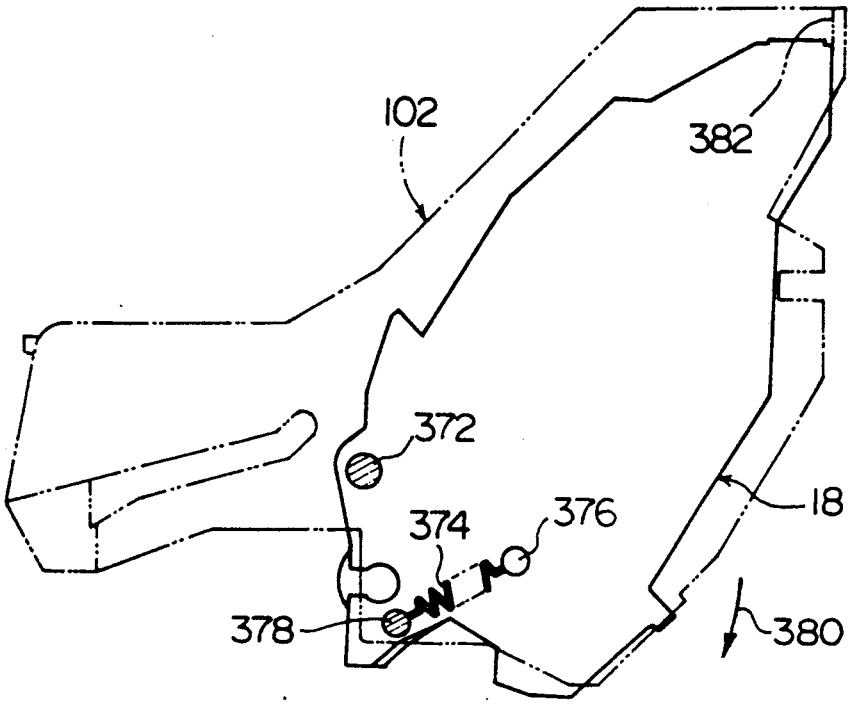
Fig. 14-A
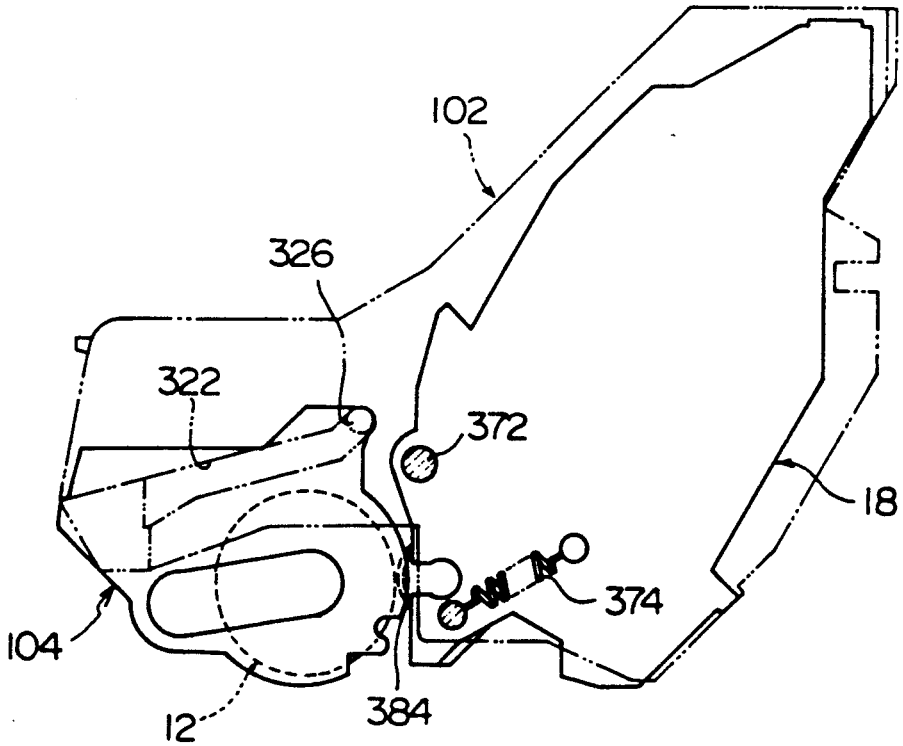
Fig. 14-B

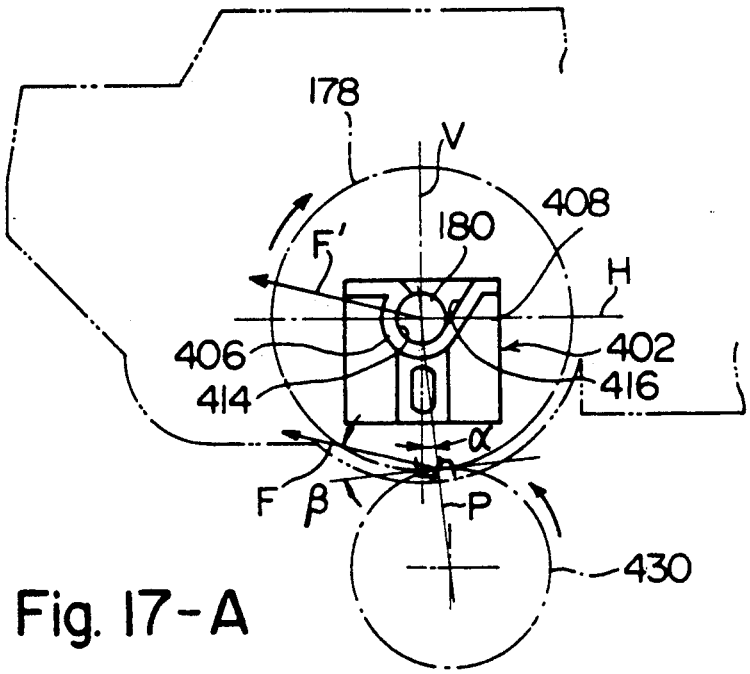
Fig. 17-A
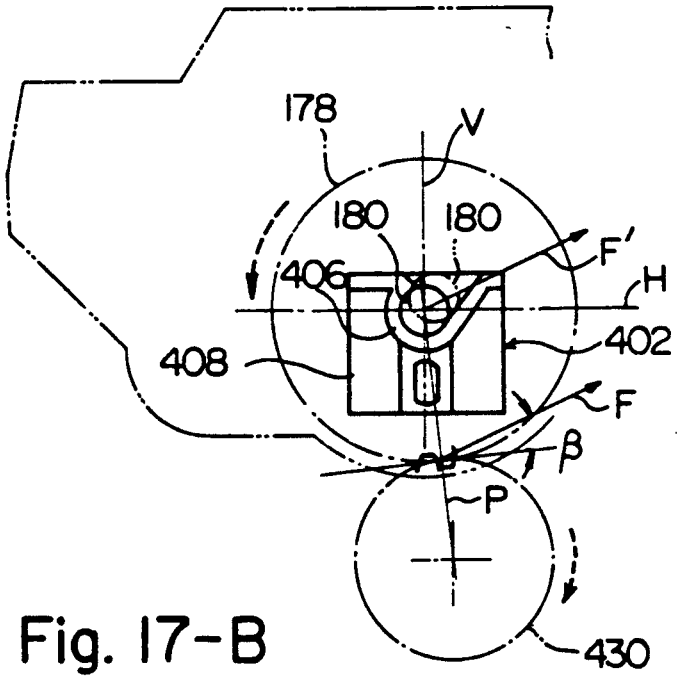
Fig. 17-B

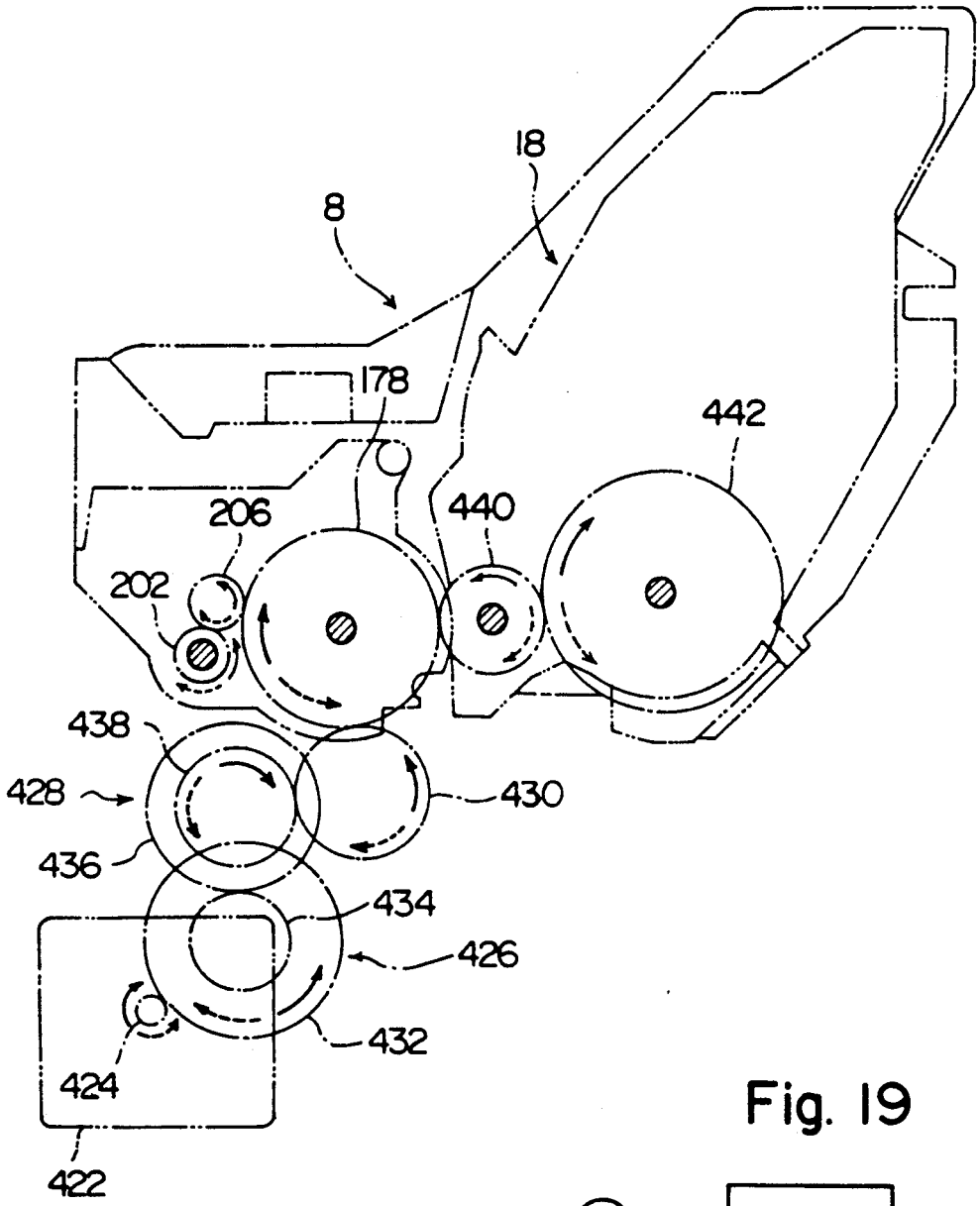
Fig. 18
Fig. 19
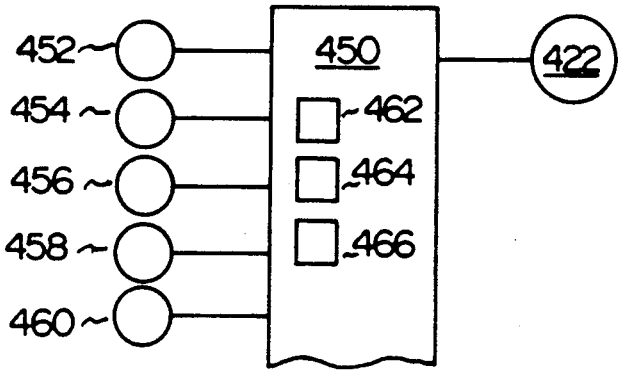

IMAGE-FORMING MACHINE

FIELD OF THE INVENTION

This invention relates to an image-forming machine such as a laser beam printer or an electrostatic copying machine.

DESCRIPTION OF THE PRIOR ART

It is known that there is in widespread use an image-forming machine of the type equipped with a rotating drum having a photosensitive member on its surface, a developing device for developing a latent electrostatic image formed on the surface of the photosensitive member to a toner image, and a cleaning device for removing the toner remaining on the surface of the photosensitive member after the development. The rotating drum, developing device and cleaning device are mounted on a unit frame to constitute a so-called process unit. Conveniently, the process unit is mounted detachably on the main body of the image-forming machine. Frequently, a corona discharger for uniformly charging the surface of the photosensitive material is also mounted on the unit frame. Usually, the developing device includes a magnetic brush mechanism consisting of a hollow cylindrical sleeve and a permanent magnet disposed therein and a blade adapted to act on the surface of the sleeve. The blade is pressed against the surface of the sleeve to provide a very thin layer of a developer on the surface of the sleeve. The cleaning device conveniently comprises an elastic blade to be pressed against the surface of the photosensitive member. When the process unit is mounted on the main body of the image-forming machine, the rotating drum in the process unit is drivingly coupled to a driving source provided in the image-forming machine via a gear train. The sleeve of the magnetic brush mechanism which is a non-driven element in the developing device is drivingly coupled to the rotating drum, and therefore, also to the driving source via the rotating drum.

The conventional image-forming machine of the above type, however, has various problems to be solved.

Firstly, the process unit comprising the rotating drum, the developing device and the cleaning device must be replaced entirely, and for example, even when the developing device therein is still usable, it is discarded with the other elements which have become useless.

Secondly, when in one unit consisting of the rotating drum, the developing device and the cleaning device, it is desired to detach the rotating drum from the unit, the developing device and the cleaning device should also be detached. In particular, when the developing device is detached, localization and scattering of the developer are likely to occur during the detaching operation.

Thirdly, in the type in which the process unit is to be mounted on the main body of the image-forming machine, a supporting-guiding means is fixedly provided in the main body of the image-forming machine to support and guide the process unit at the time of mounting. Accordingly, it is not easy to mount and detach the process unit.

Fourthly, part of the rotating drum is exposed outside during the mounting of the process unit, and the photosensitive member on the surface of the rotating drum is likely to be injured during the mounting operation.

Fifthly, when an elastic blade which may be provided to remove the toner is pressed against the surface of the drum during transportation and storage of the process unit, the elastic blade may undergo deformation or the photosensitive member on the surface of the rotating drum may be degraded.

Sixthly, although not limited to the above type of image-forming machine, the entire machine becomes large-sized to provide a space for recovering the spent toner by cleaning.

Seventhly, the rotating drum tends to be elevated from its normal required position owing to the transmitting force produced in a gear train which drivingly couples the driving source in the main body of the image-forming machine to the rotating drum in the process unit.

Eighthly, in a developing device comprising a blade adapted to be pressed against the surface of the sleeve to make the developer layer on the sleeve surface sufficiently thin, a pool of the developer is formed between the free end of the blade and the sleeve, and if the developer contains foreign matter such as dirts and dusts, the foreign matter gathers between the blade and the sleeve. The presence of the foreign matter impedes transfer of the developer and a uniform thin layer of the developer cannot be formed. Consequently, a good developing action fails.

Ninthly, when a cleaning device comprising an elastic blade to be pressed against the surface of the photosensitive member is used, the elastic blade may bring foreign matter (such as paper dust from a receptor sheet to which a toner image is to be transferred) which may exist between the surface of the photosensitive member and the elastic blade into press contact with the surface of the photosensitive member. Hence, the presence of the foreign matter is likely to result in poor cleaning or in injuring the photosensitive member.

SUMMARY OF THE INVENTION

It is an object of this invention to solve the various problems described above of the conventional image-forming machine.

Other objects of this invention along with various technical advantages achieved by this invention will become apparent from the following detailed description made with reference to the accompanying drawings.

BRIEF DESCRIPTION OF THE ACCOMPANYING DRAWING

FIGS. 14-A and 14-B are partial outline sectional views showing the state of the developing device when the second unit is not mounted on the first unit, and when the second unit is mounted on the first unit, respectively.

Figure 1:
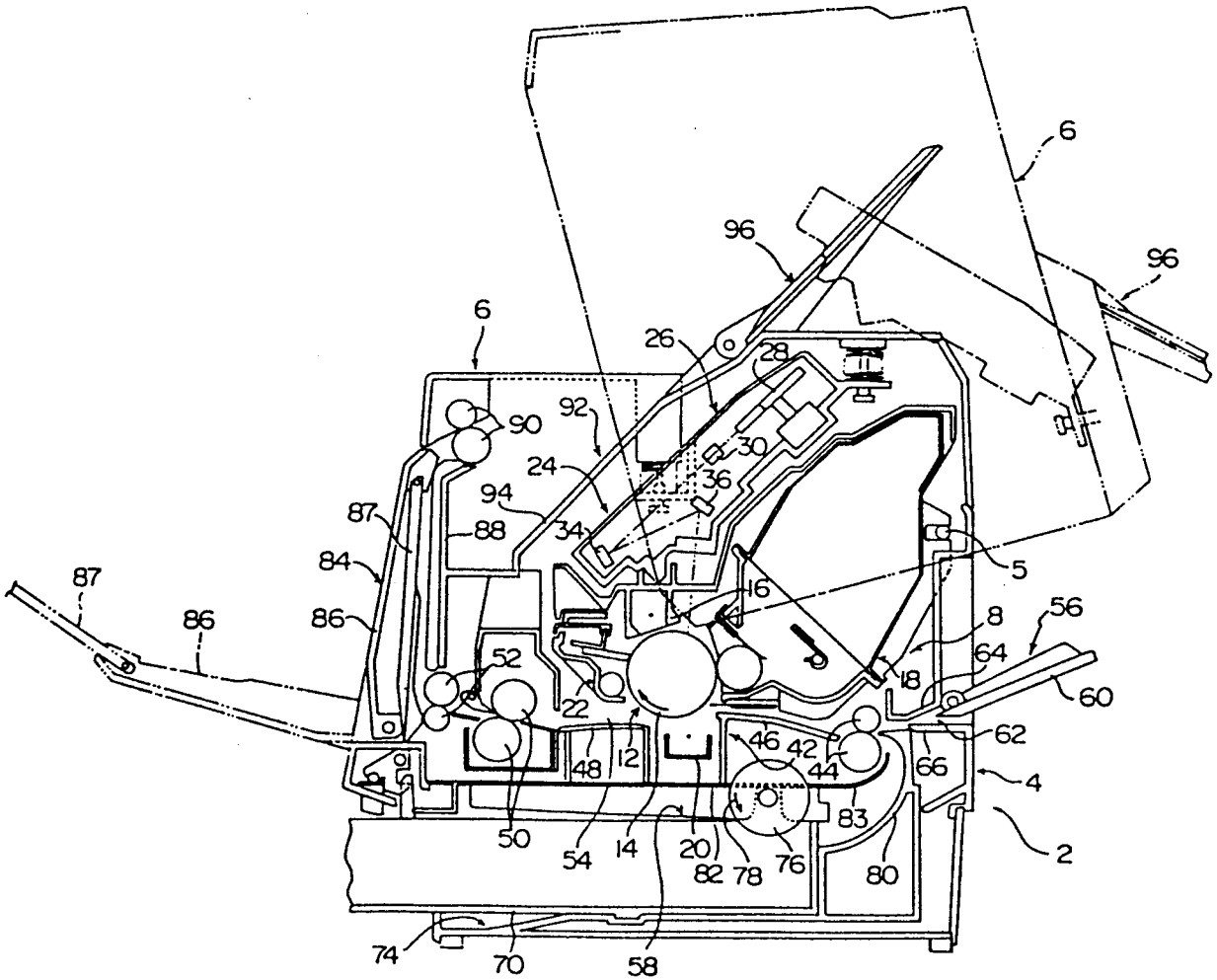
FIG. 1 is a simplified sectional view of a laser beam printer as one example of the image-forming machine constructed in accordance with the present invention.
Figure 15:
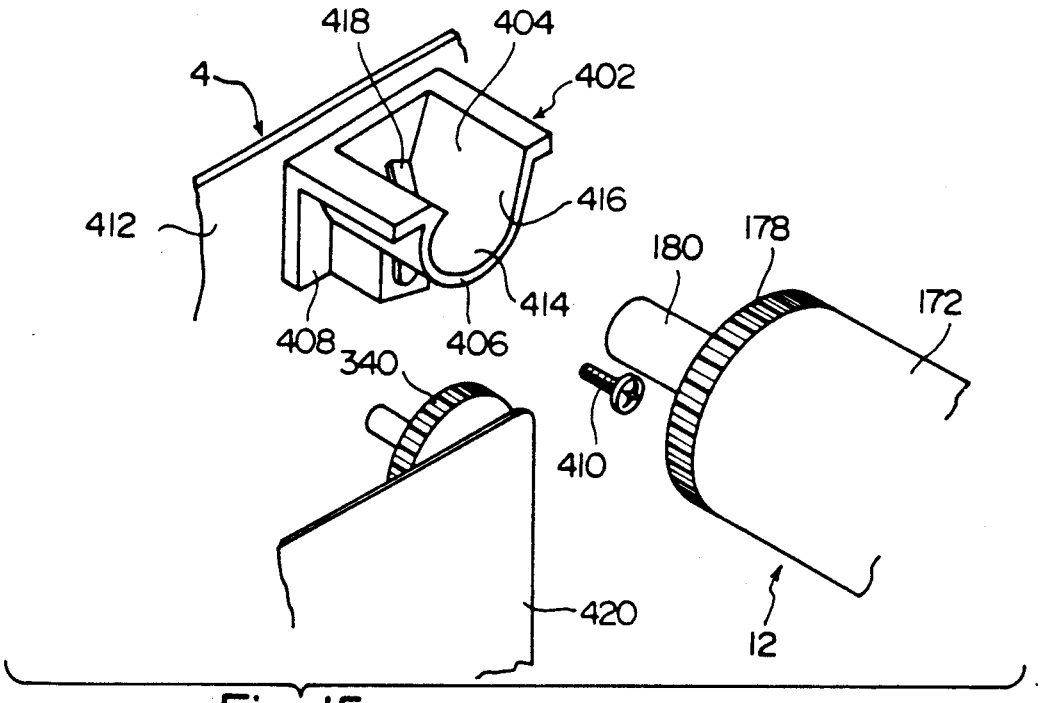

FIG. 15 is a partial exploded perspective view for illustrating a structure supporting one end portion of the rotating drum in the laser beam printer shown in FIG. 1.

Figure 16:
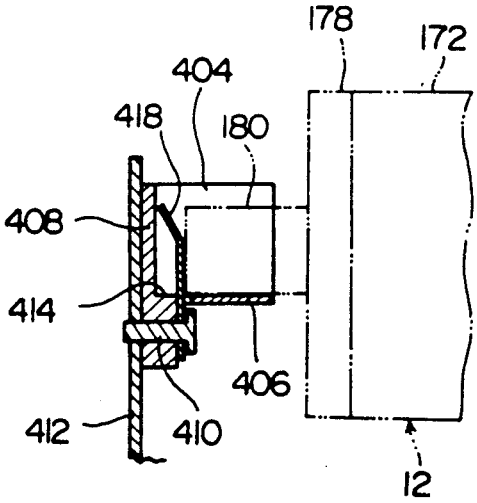

FIG. 16 is a sectional view showing the structure supporting one end portion of the rotating drum in the laser beam printer of FIG. 1.

FIG. 17-A and 17-B are simplified views for illustrating the direction of action of the transmitting force when the driving source is rotated in a normal direction and the direction of action of the transmitting force when the driving source is rotated in an inverse direction in the laser beam printer in FIG. 1, respectively.

FIG. 18 is a simplified view showing part of a driving system in the laser beam printer of FIG. 1.

FIG. 19 is an outline view showing part of a control system in the laser beam printer of FIG. 1.

Figure 20:
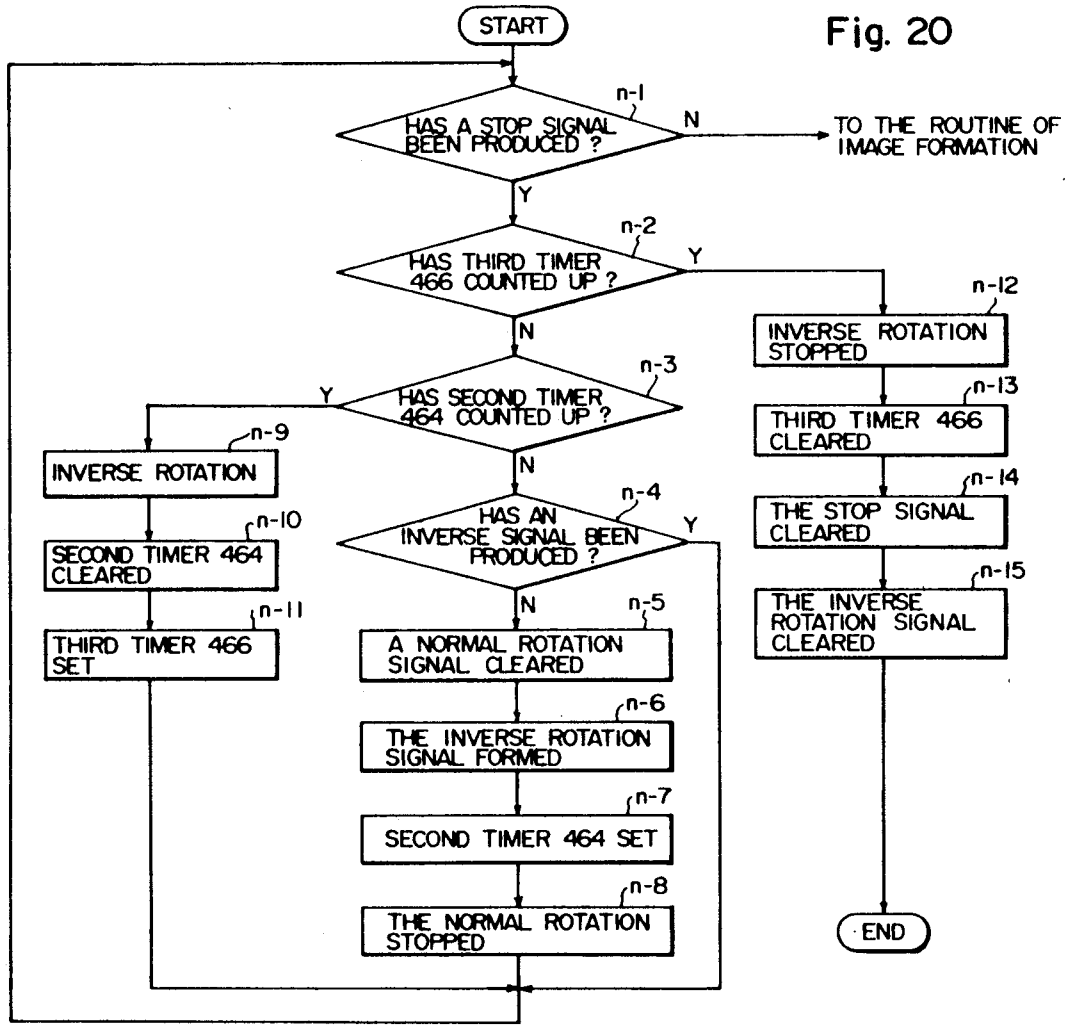

FIG. 20 is a flow chart showing a controlling operation for stopping the normal rotation of the driving source in the laser beam printer of FIG. 1.

DETAILED DESCRIPTION OF THE PREFERRED EMBODIMENTS

One specific embodiment of the image-forming machine of the invention will be described in detail with reference to the accompanying drawings.

Outline of Laser Beam Printer as a Whole

FIG. 1 shows one embodiment of the laser beam printer as one example of the image-forming machine of the invention. The laser beam printer illustrated in FIG. 1 has a main body shown generally at 2. The main body 2 includes a lower housing 4 and an upper openable-closable housing 6 mounted for free opening and closing on the lower housing 4 via a shaft 5 extending in a direction perpendicular to the sheet surface in FIG. 1 and constituting a pivot axis. The upper housing 6 is free to pivot between a closed position shown by a solid line in FIG. 1 and an open position shown by a two-dot chain line in FIG. 1.

A process unit 8 is disposed nearly centrally in the main body 2, and is detachably mounted on the main body 2 as described below. The process unit 8 is provided with a rotating drum 12 constituting an image bearing means, and an electrostatographic material is disposed on the peripheral surface of the rotating drum 12. Around the rotating drum 12 to be rotated in the direction shown by an arrow 14 are disposed a charging corona discharger 16, a developing device 18, a transfer corona discharger 20 and a cleaning device 22. The rotating drum 12, the corona discharger 16, the developing device 18 and the cleaning device 22 constitute the process unit 8 which will be described in greater detail hereinafter.

An optical unit 24 is provided in the upper portion of the inside of the main body 2, more specifically above the process unit 8. The optical unit 24 includes a box-like unit housing 26 which is mounted on the inside surface of the upper housing 6. Within the housing 26 are disposed a laser beam source (not shown), a rotating polygon mirror 28 to be revolved in a predetermined direction, an image-forming lens 30, a first reflecting mirror 34 and a second reflecting mirror 36. The laser beam source (not shown) irradiates a laser beam based on, for example, an image information outputted from a computer toward the rotating polygon mirror 28. The laser beam reflected from the rotating polygon mirror 28 reaches the first reflecting mirror 34 via the image-forming lens 30 as shown by a one-dot chain line in FIG. 1. It is reflected by the first reflecting mirror 34 and the second reflecting mirror 36 and then projected onto the surface of the rotating drum 12.

In the lower portion of the inside of the main body 2, specifically below the process unit 8, is disposed a transfer mechanism shown generally at 42. The transfer mechanism 42 includes a transfer roller pair 44, a guide plate 46, a guide plate 48, a fixing roller pair 50 and a first discharge roller pair 52 which define a transfer passage 54 for transferring a sheet material such as a recording sheet. In the illustrated embodiment, the upstream end of the transfer passage 54 is bifurcated. One branch extends to the right in a straight line, and a hand-insertion feed means 56 is provided at its upstream end. The other branch curves and extends downwardly, and at its upstream end (more specifically, below the transfer mechanism 42 and at the bottom portion of the main body 2), an automatic feed means 58 is provided. The hand-insertion feed means 56 is provided with a table 60 which is free to pivot between a feed position shown in FIG. 1 and a storage position (not shown) displaced upwardly, and when the hand-insertion feed means 56 is used, the table 60 is held at the feed position. When a sheet material is positioned on the table 60 and inserted through an opening 62 formed in the right surface of the main body 2, the sheet material advances between the under surface of a guide wall 64 and the upper surface of a guide wall of the lower housing 4 and conducted to the transfer roller pair 44. The automatic feed means 58 includes a cassette 70 for loading a stack of sheet materials. The cassette 70 is detachably loaded into a cassette-receiving section 74 defined in the bottom portion of the main body 2 through an opening formed in the left surface of the main body 2. A feed roller 76 is disposed above the cassette-receiving section 74. When the feed roller 76 is revolved in the direction shown by an arrow 78, the sheet material is delivered from the cassette 70 by the action of the feed roller 76. The delivered sheet material passes through a guide wall 80 of the lower housing 4 and a guiding portion 83 provided in a partitioning wall 82, and is conducted to the conveyor roller pair 44.

The downstream end of the transfer passage 54 is also bifurcated, and in regard to this, an opening-closing portion 84 of the upper housing 6 is adapted to be selectively held at a first position shown by a two-dot chain line in FIG. 1 and a second position shown by a solid line in FIG. 1. When the opening-closing portion 84 composed of a first member 86 and a second portion 87 pivotally linked to the first member 86 is at the first position (at which time the second member 87 is held in a positional relationship projecting from the first member 86), the sheet material sent from the first discharge roller pair 52 is discharged out of the main body 2 and received in the inside surface (the upper surface shown by the two-dot chain line) of the opening-closing portion 84. On the other hand, when the opening-closing portion 84 is at the second position (at which time the second member 87 is maintained in a positional relationship overlapping the first member 86), the sheet material sent from the first discharge roller pair 52 passes between the opening-closing portion 84 in the upper housing 6 and an upstanding wall portion 88 and is conveyed upwardly, and by the action of a second discharge roller pair 90, the sheet material is discharged into a receiving portion 92 defined in the upper surface of the main body 2. The receiving portion 92 is defined by an inclined upper wall 94 in the upper housing 6. An auxiliary receiving member 96 is mounted on the upper end portion of the inclined upper wall 94 for free pivotal movement between a receiving position shown in FIG. 1 and a storage position (not shown).

The operation of the laser beam printer will be described in a general manner.

While the rotating drum 12 is rotated in the direction of arrow 14, the charging corona discharger 16 charges the photosensitive material of the rotating drum 12, then a laser beam from the laser beam source (not shown) of the optical unit 24 is projected onto the photosensitive member, and consequently, a latent electrostatic image corresponding to the image information is formed on the surface of the photosensitive material. By the action of the developing device 18, a toner is applied to the latent electrostatic image on the photosensitive member. Thereafter, a sheet material such as a recording sheet fed to the transfer passage from the hand-insertion feed means 56 or the automatic feed means 58 is brought into contact with the photosensitive member, and by the action of the transfer corona discharger 20, the toner image on the photosensitive member is transferred to the sheet material. The sheet material having the toner image transferred thereto is peeled from the rotating drum 12 and conveyed to the fixing roller pair 50, and by the action of the fixing roller pair 50, the toner image is fixed to the surface of the sheet material. The sheet material having the toner image fixed thereto is conveyed by the first discharge roller pair 52 and discharged onto the opening-closing portion 84 when the opening-closing portion 84 is at the first position. It is seen from FIG. 1 that when the sheet material is discharged onto the opening-closing portion 84, that surface of the sheet material on which the image is formed is directed upwards. On the other hand, when the opening-closing portion 84 is at the second position, the sheet material conveyed to the discharge roller 52 is further conveyed upwardly and discharged to the receiving portion 92 by the action of the second discharge roller pair 90. As is seen from FIG. 1, when the sheet material is discharged onto the receiving portion 92, that surface of the sheet material on which the image is formed is directed downwards. In the meanwhile, the rotating drum 12 continues to be rotated, and the toner remaining on the surface of the photosensitive member is removed by the action of the cleaning device 22.

Process Unit

Now, with reference to FIGS. 2 to 4 in conjunction with FIG. 1, the process unit 8 will be described in detail.

Figure 2:
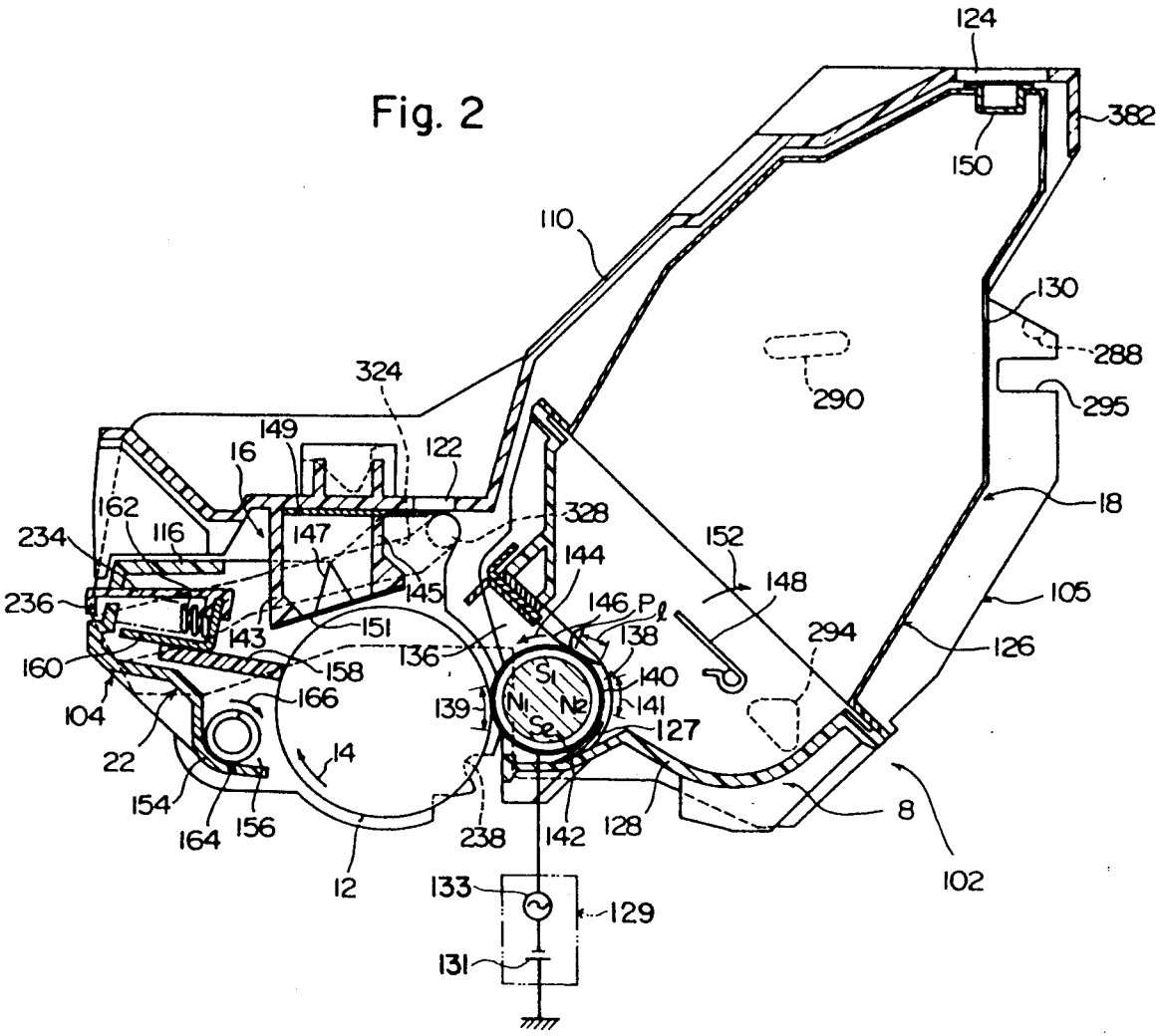
FIG. 2 is a sectional view showing a process unit in the laser beam printer of FIG. 1.
Figure 3:
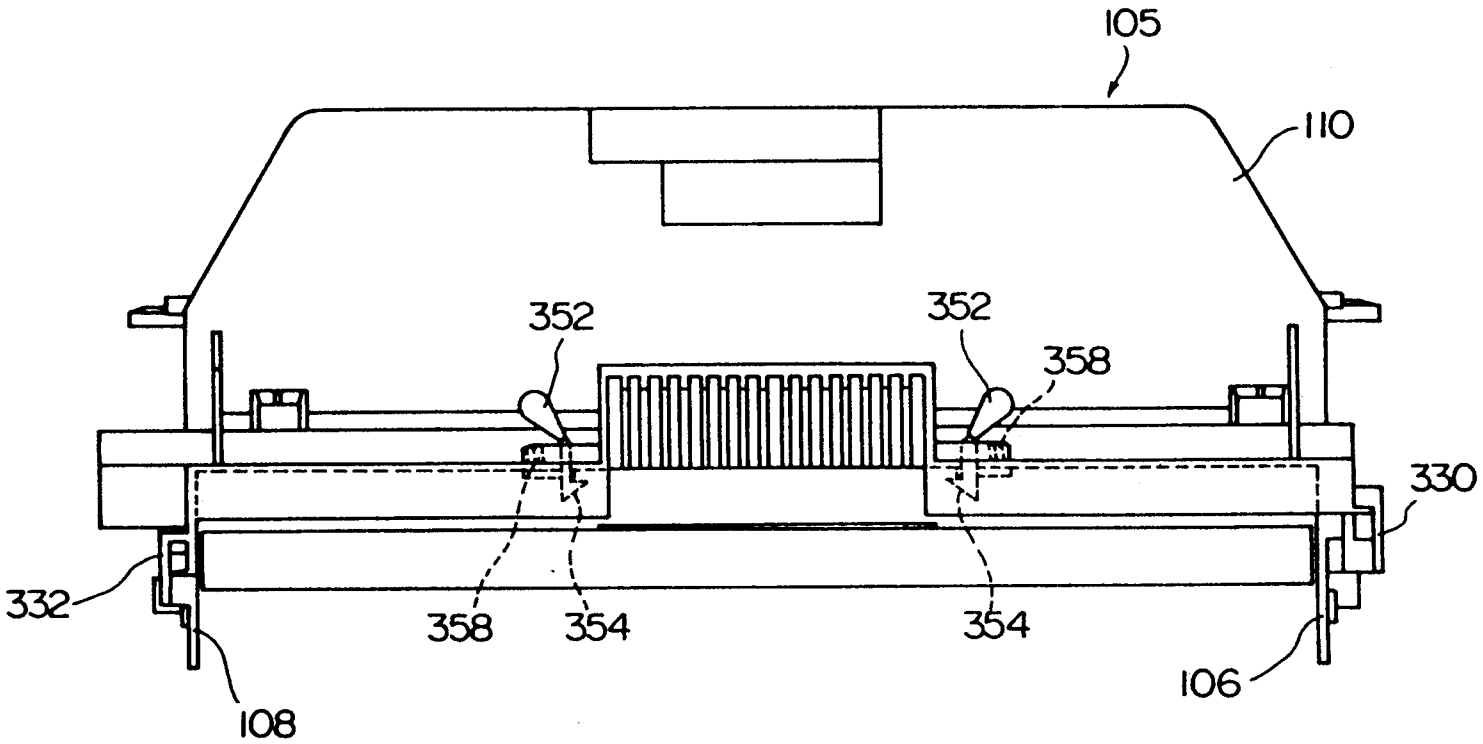
FIG. 3 is a side elevation showing a first unit in the process unit of FIG. 2.
Figure 4:
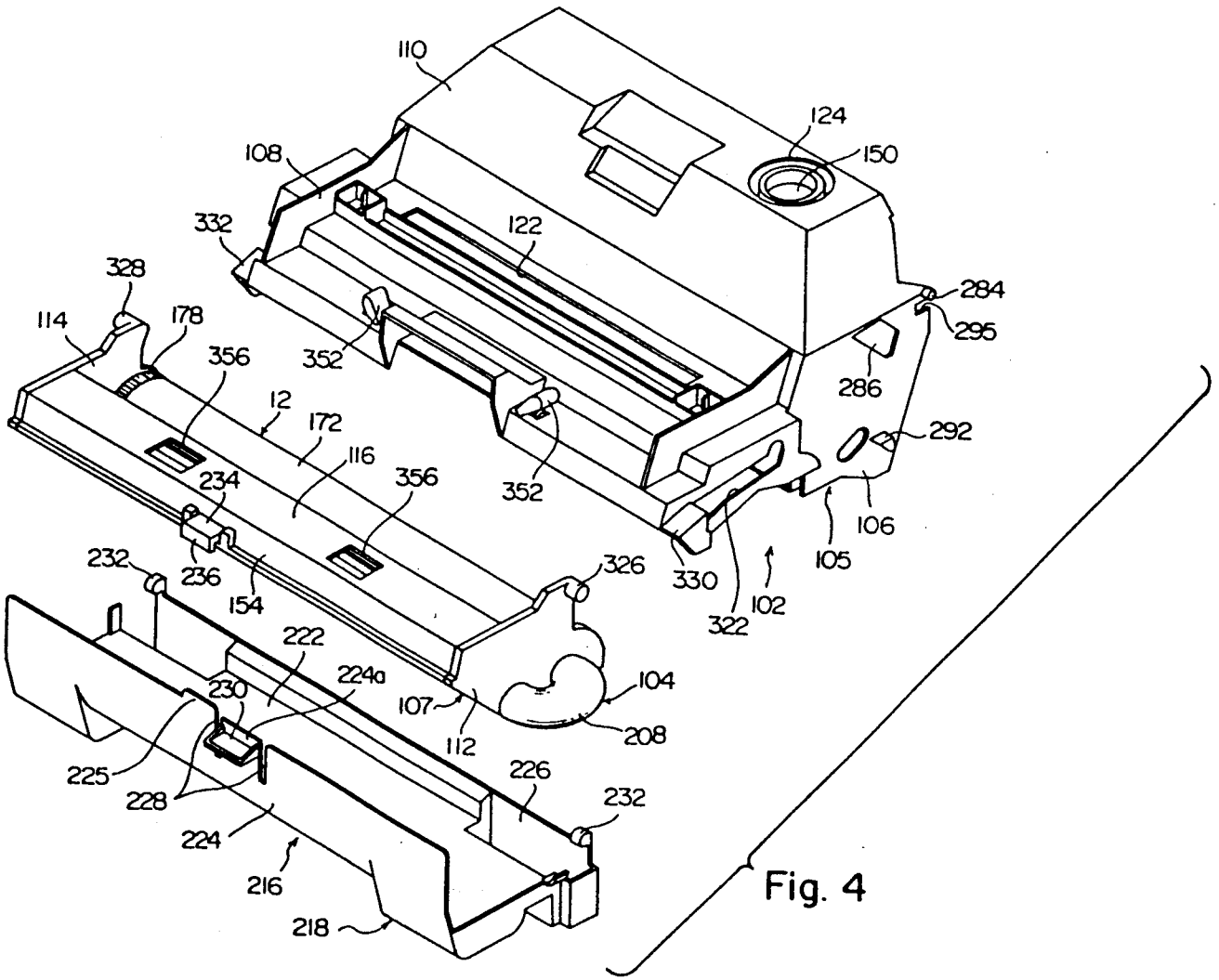
FIG. 4 is an exploded perspective view showing a first unit, a second unit and a cover member adapted to be attached to the first unit in the process unit of FIG. 2.

Mainly with reference to FIGS. 2 and 4, the process unit 8 is comprised of a first unit 102 and a second unit 104 which can be mounted on, and detached from, each other. The charging corona discharger 16 and the developing device 18 are provided in the first unit 102, and the rotating drum 12 and the cleaning device 22, in the second unit 104.

The first unit 102 will first be described in detail. The first unit 102 includes a unit frame 105 having a pair of end walls 106 and 108 spaced from each other in a predetermined direction (the direction perpendicular to the sheet surface in FIGS. 1 and 2, and in the left-right direction in FIG. 3). The upper surface of the unit frame 105 extending across the end walls 106 and 108 is covered with an upper wall 110. The left portion in FIG. 2 of the upper wall 110 extends nearly horizontally, and its right portion is inclined upwardly toward the right in FIG. 2. The developing device 18 is disposed in the right part of the first unit frame 105 between the end walls 106 and 108. The charging corona discharger 16 is disposed in the upper end part of the left portion of the first unit frame 105 between the end walls 106 and 108.

Mainly with reference to FIG. 2, the developing device 18 will be described generally. The developing device 18 is provided with a development housing 126 comprised of a bottom housing 128 and an upper housing 130 fixed to the upper end of the bottom housing 128. An opening 136 is formed in the left surface (the surface opposing the rotating drum 12) of the bottom housing 128 in FIG. 2, and a magnetic brush mechanism 138 is disposed in the opening 136. The magnetic brush mechanism 138 is comprised of a hollow cylindrical sleeve 140 and a cylindrical permanent magnet 142 disposed within the sleeve 140. The sleeve 140 is formed of a non-magnetic material such as aluminum. The permanent magnet 142 has four magnetic poles, i.e. a developing pole $N_1$ corresponding to a development zone 139, a supply pole $N_2$ corresponding to a supply zone 141 (a zone opposite to the development zone 139), and conveying poles $S_1$ and $S_2$ between the supply pole $N_2$ and the development pole $N_1$. The supply pole $N_2$ and the development pole $N_1$ are N poles, and the conveying poles $S_1$ and $S_2$ are S poles.

An agitating member 148 is disposed at the bottom portion of the development housing 126. A blade 146 is disposed above the magnetic brush mechanism 138. The base portion of the blade 146 is secured to the upper end portion of the opening 136 of the development housing 126, and its free end portion extends toward the sleeve 140 and to the right bottom in FIG. 2 and comes into press contact with the surface of the sleeve 140 in an area between the conveying pole $S_1$ and the supply pole $N_2$. The blade 146 may be formed of a material having elasticity, such as phosphor bronze, and comes into press contact with the surface of the sleeve 140 by its own elastic deformation. The projecting length (l) of the blade 146 ranging from a point of contact, P, of the blade 146 with the sleeve 140 to its free end may be about 2 to 6 mm. A leakage preventing member 127 is provided below the magnetic brush mechanism 138. The base portion of the leakage preventing member 127 is fixed to the inside surface of the bottom of the development housing 126, and its free end portion makes contact with the sleeve 140. The leakage preventing member 127 may be formed of a urethane rubber, for example.

The sleeve 140 and the agitation member 148 in the development device are drivingly coupled to a driving source which may be a reversible electric motor (this driving coupling will be described further hereinbelow). When a latent electrostatic image formed on the photosensitive member is to be developed, the sleeve 140 is rotated in a direction shown by an arrow 144, and the agitation member 148, in a direction shown by an arrow 152. A one-component developer composed only of a magnetic toner, for example, is held in the development housing 126. During the development operation, a development bias voltage is applied to the sleeve 140 of the magnetic brush mechanism 138 by the action of a development bias source 129 which may be comprised of a dc voltage source 131 for applying a dc voltage and an ac voltage source 133 for applying an ac voltage.

In the developing device 18, the agitating member 148 revolving in the direction of arrow 152 supplies the developer existing at the bottom of the development housing 126 toward the magnetic brush mechanism 138 while agitating it. The developer so supplied is magnetically held onto the surface of the sleeve 140 in the supply zone 141 by the action of the supply pole $N_2$ of the permanent magnet 142. The developer so held is conveyed toward the developing zone 139 by the action of the sleeve 140 rotating in the direction of arrow 144, and undergoes the action of the blade 146 between the supply pole $N_2$ and the conveyor pole $S_1$ on the upstream side. The blade 146 acts on the developer held onto the surface of the sleeve 140 and removes the excess of the developer whereby a thin layer of the developer is formed on the surface of the sleeve 140. The developer held by the sleeve 140 is moved further in the direction of arrow 144 and under the action of the conveying pole $S_1$, is fed to the developing zone 134. In the developing zone 139, the corresponding developing pole $N_1$ exists and the developer held by the surface of the sleeve 140 is supplied to the surface of the rotating drum 12 rotating in the direction of arrow 14. As a result, the latent electrostatic image formed on the photosensitive member on the rotating drum 12 is developed to a toner image. The developer which has passed through the developing zone 139 is conveyed in the direction of arrow 144 by the rotation of the sleeve 140, undergoes the action of the conveying pole $S_2$ on the downstream side, and is returned to the development housing 126 after moving below the magnetic brush mechanism 138 and passing between the sleeve 140 and the leakage preventing member 127.

Now, the charging corona discharger 16 will be described generally. The corona discharger 16 is provided with a discharger housing comprised of part of the upper wall 110 of the first unit frame 105 and suspending walls 143 and 145 formed as a unit with the upper wall 110. The first unit frame 105, part of which defines the discharger housing, is formed preferably of a synthetic resin having excellent arc resistance, for example a modified poly(phenylene oxide) or modified poly(-phenylene ethylene). Within the discharger housing, a corona wire 147 is stretched taut, and a mesh metallic member 151 acting as a grid electrode is provided in the opening of the discharger housing. A corona from the corona wire 147 of the charging corona discharger 16 is applied to the rotating drum 12 to impart a charge of a specific polarity to the surface of the photosensitive member of the rotating drum 12. The amount of the charge imparted to the surface of the photosensitive member is controlled by the voltage applied to the metallic member 151.

Having regard to the fact that the charging corona discharger 16 and the developing device 18 are provided in the first unit 102, a slender rectangular opening 122 for exposure is formed in the upper wall 110 of the first unit frame 105, and a circular opening 124 is formed in the right end portion of the upper wall 110. Corresponding to the opening 124, a circular supply opening is formed in the upper surface of the development housing 126 of the developing device 18. A sealing cap 150 is fitted in the supply opening (see FIG. 4, too). Hence, by removing the sealing cap 150, a fresh toner can be supplied to the development housing 126 through the opening 124 in the first unit frame 105 and the opening in the development housing 126.

With reference to FIGS. 2 and 4, the second unit 104 will be described. The second unit 104 includes a second unit frame 107 having a pair of end walls 112 and 114 spaced from each other in the aforesaid predetermined direction (the direction perpendicular to the sheet surface in FIGS. 1 and 2). The upper surface of the second unit frame 107 between the end walls 112 and 114 is covered with an upper wall 116. The rotating drum 12 and the cleaning device 22 are mounted on the second unit frame 107.

Figure 5:
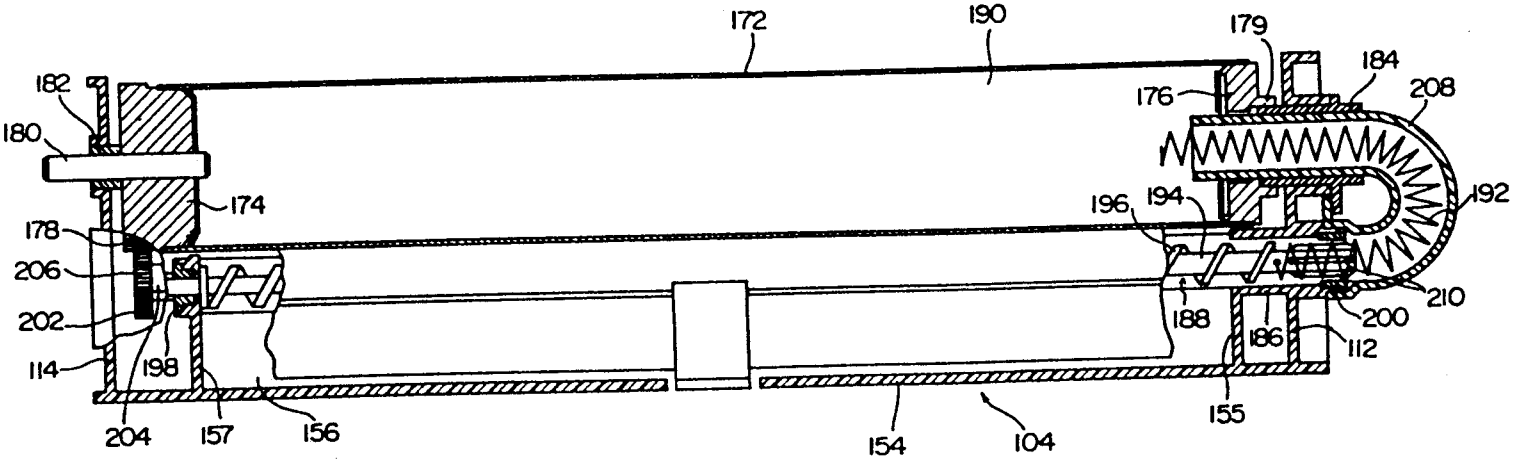
FIG. 5 is a sectional view showing the second units in the process unit of FIG. 2.

With reference also to FIG. 5, the cleaning device 22 will be described. The cleaning device 22 includes a housing member 154 both ends of which are connected to the end walls 112 and 114 of the second unit frame 107. Inside supporting walls 155 and 157 connected to the inside surface of the housing member 154 are disposed inwardly of the end walls 112 and 114 respectively. Accordingly, as can be seen from FIGS. 2 and 5, the housing member 154 and the inside supporting walls 155 and 157 define a toner recovery chamber 156 for recovering the toner. Above the toner recovery chamber 156 is disposed an elastic blade 158 which may be formed of, for example, a urethane rubber. The base portion of the elastic blade 158 is fixed to an L-shaped supporting plate 160, and its free end portion projects toward the rotating drum 12. It is seen from FIGS. 6 and 7 that the supporting plate 160 is mounted across the inside supporting walls 155 and 157 so as to be free to move toward and away from the rotating drum 12, and is free to move between a receded position shown in FIG. 6 and an advanced position shown in FIG. 7. When the supporting plate 160 is at the receded position, the free end of the elastic blade 158 is away from the rotating drum 12 and is held at a non-operative position at which it does not act on the photosensitive member. On the other hand, when the supporting plate 160 is at the advanced position, the free end portion of the elastic blade 158 comes into press contact with the rotating drum 12 and is held at an operative position at which it acts on the photosensitive member. A biasing spring 162 constituting biasing means is interposed between the supporting plate 160 and the upper end portion of the housing member 154. The biasing spring 162 biases the supporting plate 160 toward the above advanced position, and causes the elastic blade 158 to make press contact with the surface of the rotating drum 12 under a predetermined pressure. A toner transfer means 164 which will be described further hereinbelow is disposed at the bottom of the toner recovery chamber 156.

In the cleaning device 22, the elastic blade 158 acts on the surface of the rotating drum 12 rotating in the direction of arrow 14, and the toner remaining on the surface of the photosensitive member after the transfer is removed by the action of the elastic blade 158. The toner so removed drops into the toner recovery chamber 156 and led to its bottom. The toner collected at the bottom of the recovery chamber 156 is recovered into the space inside the rotating drum 12 by the action of the toner transferring means 164 rotating in the direction shown by an arrow 166.

The rotating drum 12 will be further described. The rotating drum 12 includes a hollow cylindrical drum body 172 which may be formed of, for example, an aluminum alloy. An electrostatographic photosensitive member is disposed on its peripheral surface. End wall members 174 and 176 are fixed to the opposite end portions of the drum body 172. One end portion of the end wall member 174 projects outwardly from one end of the drum body 172, and a large gear (driven gear) 178 is provided on the peripheral surface of this projecting end portion. A short rod 180 is fixed to the end wall member 174, and mounted rotatably on the end wall 114 of the second unit frame 107 via a bearing member 182. The short rod 180 constituting a shaft portion at one end portion of the rotating drum 12 projects beyond the end wall 114 of the second unit frame 107, and the projecting end portion of the short rod 180 is supported by a receiving means disposed in the lower housing 4 of the main body 2 of the image-forming machine (this will be described in detail hereinbelow). An annular flange 179 is provided on the outside surface of the other end wall member 176. The flange 179 is rotatably supported on the inside projecting portion of a supporting sleeve 184 fixed to the end wall 112 of the second unit frame 107.

The toner transferring means 164 extends within a hollow space of the rotating drum 12. A sleeve-like wall 186 is provided extending through the inside supporting wall 155 and the end wall 112. The toner transferring means 164 includes a first transferring member 188 disposed at the bottom portion of the toner recovery chamber 156 and a second transferring member 192 for conducting the recovered toner in the toner recovery chamber 156 to the inside space 190 (defined by the end walls 174 and 176 and the drum body 172) of the rotating drum 12. The first transferring member 188 has a shaft portion 194 and a helical member 196 wound about the peripheral surface of the shaft portion 194, and the opposite ends of the shaft portion 194 are rotatably supported via bearings 198 and 200. One end portion of the shaft portion 194 extends toward the inside surface of the end wall 114 through the inside supporting wall 157, and a gear 202 is fixed to this one end portion. The gear 202 is in mesh with the large gear 178 of the rotating drum 12 via a gear 206 rotatably mounted on a short rod 204 provided on the outside surface of the inside supporting wall 157. The toner transferring means 164 further includes a nearly U-shaped hollow cylindrical member 208. One end portion of the hollow cylindrical member 208 is fixed to that part of the sleeve-like wall 186 which projects from the end wall 112, and its o&her end portion projects into the inside space 190 of the rotating drum 12 through the supporting sleeve 184 and the end wall 176 of the rotating drum 12. The second transferring member 192 is disposed within the hollow cylindrical member 208. The second transferring member 192 may be formed of a flexible helical material such as a coil spring. Its one end portion is connected to the shaft portion 194 of the first transferring member 188, and its other end extends through the hollow cylindrical member 208 and projects slightly into the inside space 190 of the rotating drum 12.

When the rotating drum 12 rotates in the direction of arrow 14, the first transferring member 188 rotates in the direction of arrow 166 (FIG. 2) via the large gear 178 and the gears 206 and 202, and the rotating force of the first transferring member 188 is transmitted to the second transferring member 192. The spent toner recovered in the toner recovery chamber 156 is transferred from left to right in FIG. 5 by the action of the first transferring member 188. Further, by the action of the second transferring member 192, it advances through the hollow cylindrical member 208 and is recovered into the inside space 190 of the rotating drum 12. To ensure transmission of the rotating force from the first transferring member 188 to the second transferring member 192, a plurality of axially extending short beams 210 are provided in the other end portion of the shaft portion 194 in the first transferring member 188. These short beams 210 act to slightly expand one end portion of the second transferring member 192.

In regard to the inside space 190 of the rotating drum 12 in which the used toner is received, the following should also be noted. The rotating drum 12 is so constructed that it can form about 2500 images each in an area having a specific size, for example JIS A4 size, and when about 2500 images are produced, the life of its photosensitive member substantially comes to an end. In this connection, when about 2500 images are produced, the inside space 190 of the rotating drum 12 becomes substantially full of the spent toner recovered during this time. In the specific embodiment, when about 2500 images are produced, about 68 g of the spent toner results. On the other hand, the inside diameter of the drum body 172 of the rotating drum is 27 mm, and the distance between the end walls 174 and 176 is 248 mm. The volume of the inside space 190 is prescribed at 142 $cm^3$. Hence, when about 2500 images are produced about 80% of the entire volume of the inside space 190 is filled with the spent toner, and the spent toner is discarded together with the rotating drum 12. By presetting the volume of the inside space 190 of the rotating drum 12 in this manner, the outside diameter of the rotating drum 12 can be minimized while effectively utilizing the inside space 190 of the rotating drum 12. As a result, the entire machine can be reduced in size.

Figure 7:
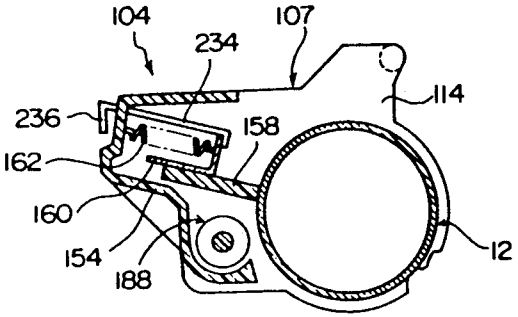
FIG. 7 is a sectional view, corresponding to FIG. 6, showing the cover means as detached from the second unit.
Figure 6:
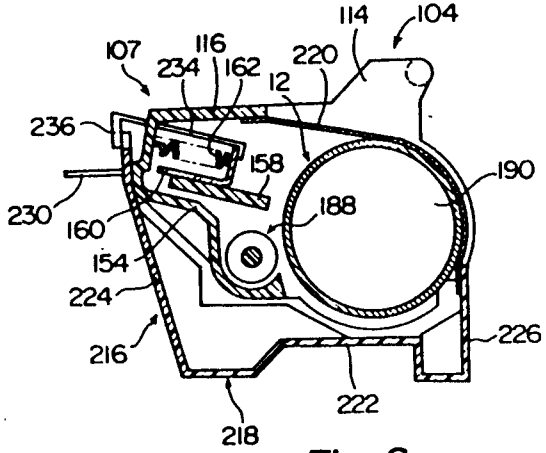
FIG. 6 is a sectional view showing a cover means as attached to the second units.

With reference to FIGS. 6 and 7 together with FIG. 4, a cover means 216 is mounted on the second unit 104 in order to protect the photosensitive member of the rotating drum 12 mounted on the second unit frame 107. The cover means 216 is mounted at the time of producing the second unit 104, and is removed from the second unit 104 at the time of use. The cover means 216 is comprised of a rigid cover member 218 and a flexible protecting sheet 220 (in FIG. 4, the protective sheet is omitted). The cover member 218 may be formed of, for example, a synthetic resin, and as shown in FIG. 6, attached to the lower portion of the second unit 104. The protecting sheet 220 may be formed of paper or a synthetic resin such as a polyester resin, and as shown in FIG. 6, attached to the upper portion of the second unit 104. In the illustrated embodiment, the cover member 218 has a bottom wall 222 and side walls 224 and 226, and a pair of notches 228 are formed at the central portion in the longitudinal direction of the side wall 224. A site 224*a* between the notches 228 is elastically deformable. An operating piece 230 is fixed to the outside surface of the site 224*a*, and an engaging projecting portion 225 is provided adjacent to the site 224*a*. A slightly upwardly projecting engaging portion 232 is provided integrally at both end portions of the other side wall 226.

A rectangular opening is formed in the upper end portion of the housing member 154 of the second unit 104. An engaging member 234 is fixed to the upper end portion of the supporting plate 160. The free end portion of the engaging member 234 projects outwardly through the opening, and a downwardly extending engaging portion 236 is provided in the projecting end portion of the engaging member 234. The engaging portion 236 may be provided directly in the supporting plate 160. Because of this construction, the cover member 218 can be mounted in position on the second unit 104 by bringing the engaging portion 232 into engagement with a semicircular depressed portion 238 (FIG. 2) defined at the right edge in FIG. 4 of the end walls 112 and 114 of the second unit frame 107 and causing the engaging projection 225 of the side wall 224 to act on the engaging portion 236 of the engaging member 234. Since in this mounted state, the engaging projection 225 of the side wall 224 acts on the engaging portion 236 of the engaging member 234 as shown in FIG. 6, the supporting plate 160 is held at the receded position, and the elastic blade 158 does not act on the surface of the rotating drum 12. Accordingly, the deformation of the elastic blade 158 and the degradation of the photosensitive member are prevented during transportation and storage. Furthermore, in the mounted state, the bottom portion 222 of the cover member 218 covers the under surface of the second unit 104; the side wall 224 covers the left surface in FIG. 6 of the second unit 104; and the side wall 226 covers the lower portion of the right surface in FIG. 6 of the second unit 104. The protecting sheet 220, which may be formed of a black polyester film, is fixed at one end to the inside surface of the upper wall 116 of the second unit frame 107. Its other end covers the space above the rotating drum 12, and is fixed to the upper end portion of the side wall 226 of the cover member 218. The protecting sheet 220 may be fixed detachably by an adhesive, and in the mounted state, covers the open right portion in the upper surface of the second unit 104 and the upper portion of the right surface in FIG. 6 of the second unit 104. Accordingly, where the cover means 216 is mounted in position, the photosensitive member is covered with the cover member 218 and the protecting sheet 220, and is not substantially exposed to outside. Accordingly, the degradation of the photosensitive member by exterior light can be accurately prevented. The cover means 216 may be detached from the second unit 104 by detaching the engaging projection 225 of the side wall 224 from the engaging portion 236 of the engaging member 234, then pivoting the cover member 218 counterclockwise in FIG. 6 about the engaging portion 232 as a center, and thereafter, while the operating portion 230 is held, pulling the cover member 218 downwardly and detaching one end portion of the protective sheet from the upper wall 116 of the second unit frame 107. As a result, the photosensitive member of the rotating drum 12 is exposed by the detachment of the cover member 218 and the protecting sheet 220 as shown in FIG. 7. Furthermore, this results in the disengagement of the engaging projection 225 of the cover member 218 from the engaging portion 236 of the engaging member 234. Thus, the supporting plate 160 acting as a supporting member is moved to the advanced position (at this time, some clearance exists between the engaging portion 236 of the engaging member 234 and the upper end portion of the housing member 154), and the free end portion of the elastic blade 158 is brought into press contact with the rotating drum 12 by the action of the biasing spring 162. When the rotating drum 12 is detached from the second unit frame 107, the supporting plate 160 is further moved to the right in FIG. 2 by the action of the biasing spring 162. Thus, the engaging portion 236 of the engaging member 234 comes into contact with the upper end portion of the housing member 154, and the above movement of the supporting plate 160 is accurately hampered.

Manner of Mounting the First Unit

Now, with reference to FIGS. 8 to 10 together with FIG. 4, the manner of mounting the first unit 102 on the main body 2 of the image-forming machine will be described.

A supporting-guiding means 252 for supporting the first unit 102 and guiding it to the main body 2 is provided. The supporting-guiding means 252 includes a pair of supporting-guiding members 254 (only one of them is shown in FIGS. 8 to 10) spaced from each other in a direction perpendicular to the sheet surface in FIGS. 8 to 10. One end portion of each of the pair of supporting-guiding members 254 is pivotally mounted on the shaft 5. The two supporting-guiding members 254 are of substantially the same structure, and in the inside surface of the upper end portion of each of the members 254 is defined a guiding channel 256 acting as a guide portion guiding the first unit 102. Specifically, a pair of protruding beams 258 and 260 spaced from each other vertically are provided in the inside surface of the supporting-guiding members 254. The lower protruding beam 260 extends substantially linearly. The right portion in FIG. 8 of the upper protruding beam 258 extends substantially linearly along the protruding beam 260, and its left end portion in FIG. 8 is inclined upwardly toward the left. Accordingly, the guide channel 256 defined between the pair of protruding beams 258 and 260 extends in the mounting direction of the first unit 102, and its insertion opening portion is relatively large. A contacting protrusion 262 is further provided in the inside surface of the lower end portion of the supporting-guiding member 254. The pair of supporting-guiding members 254 are free to pivot downwardly as shown by an arrow 264 and also upwardly from an elevated position shown in FIGS. 8 and 9.

An elevated position holding means 266 is provided for holding the pair of supporting-guiding members 254 at the above elevated position. The holding means 266 includes holding members 268 (only one of which is shown in FIGS. 8 to 10) provided in correspondence to the supporting-guiding members 254, and the lower end portions of the holding members 268 are mounted pivotally via a pin 272 on supporting base plates 270 (only one of which is shown) provided in the main body 2. An arcuate opening 274 is formed in each of the supporting base plates 270, and a sliding pin 276 is provided in the other end portion of the holding member 268 and received movably in the opening 274. An operative protrusion 278 acting on the contacting protrusion 262 of the supporting-guiding member 254 is provided in the other end of the holding member 268. A biasing spring 280 for biasing the holding member 268 counterclockwise in FIG. 8 is interposed between part of the main body 2 and the sliding pin 276 of the holding member 268. Accordingly, the holding member 268 is free to move between an operative position (the position shown by a solid line in FIGS. 8 to 10) at which the sliding pin 276 is positioned at one end portion of the opening 274 and a non-operative position (the position shown by a two-dot chain line in FIG. 8) at which the sliding pin 276 is positioned at the other end portion of the opening 274. Usually, by the action of the biasing spring 280, the holding member 268 is held at the operative position, and by the contacting of the sliding pin 276 with one end of the opening 274, its pivoting movement beyond the operative position is accurately hampered. When the holding member 268 is at the above operative position, its operative protrusion 278 acts on the under surface of the contacting protrusion 262 of the supporting-guiding member 254 to hold the supporting-guiding member 254 at the above elevated position, as shown in FIGS. 8 and 9.

Figure 10:
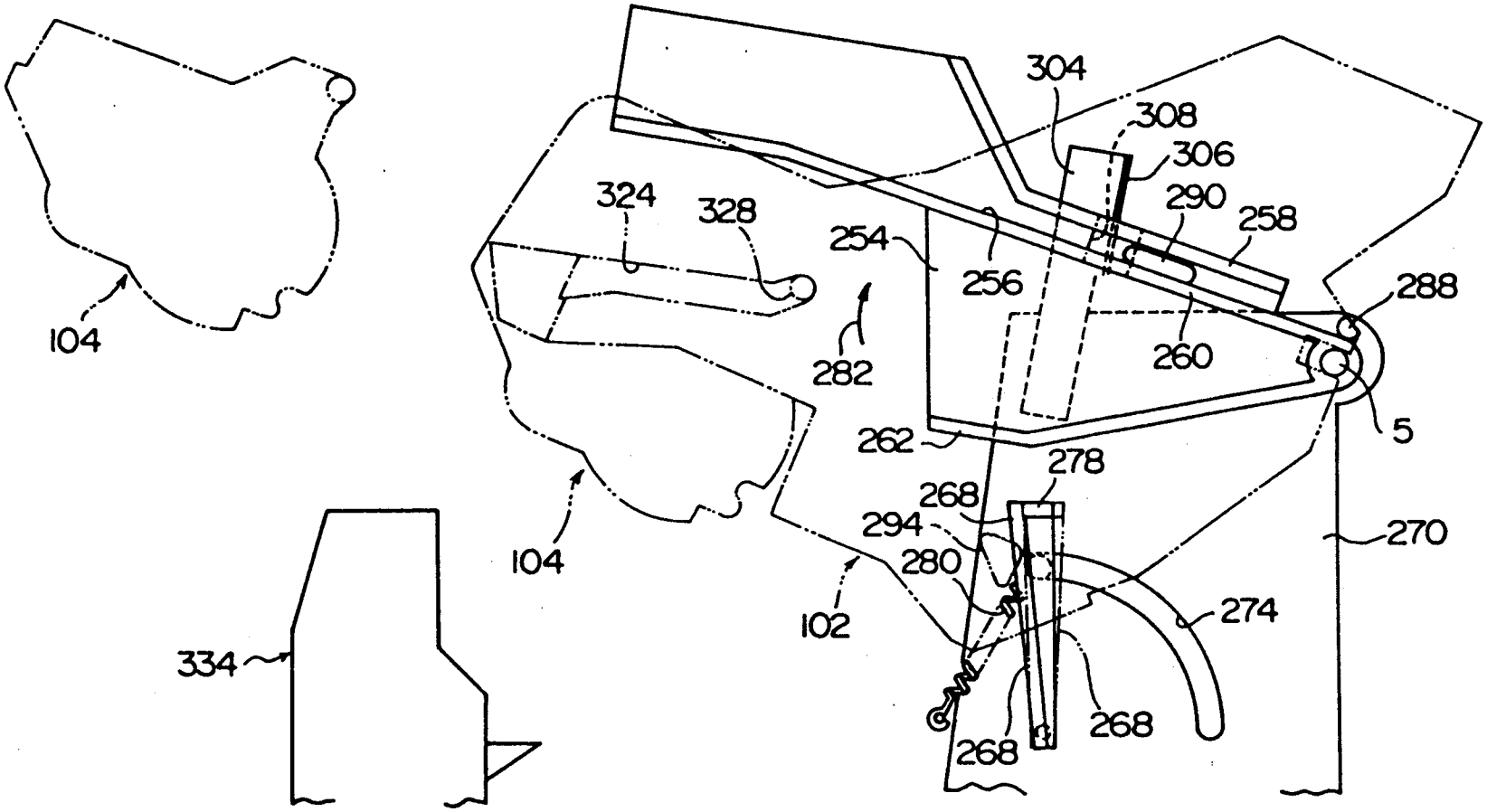
FIG. 10 is an outline view showing the relation between the process unit and the fixation device when the process unit is mounted on the main body of the laser beam printer and the supporting-guiding member is held at a detached position.

As shown in FIG. 10, the supporting-guiding member 254 can be caused to pivot further from the elevated position to a detached position shown in FIG. 10 in the direction shown by an arrow 282. When it pivots to the detached position, the contacting protrusion 262 of the supporting-guiding member 254 moves away from the operative protrusion 278 of the holding member 268 at the operative position. Therefore, the supporting-guiding member 254 must be held by hand.

In the first unit 102 supported by the supporting-guiding member 254, a pair of support protrusions 284 and 286 (see FIG. 4) are provided in the outside surface of the end wall 106 of the first unit frame 105. One support protrusion 284 (the right one in FIG. 4) is of a nearly circular cross sectional shape and the other support protrusion 286 has a slender nearly elliptical cross-sectional shape. These support protrusions 284 and 286 are detachably received in the guide channel 256 of one supporting-guiding member 254. A pair of support protrusions 288 and 290 are provided on the outside surface of the other end wall 108 of the first unit frame 105 (FIGS. 8 to 10). One support protrusion 288 (the right one in FIGS. 8 to 10) is nearly circular in cross section, and the other support protrusion 290 has a slender nearly elliptical cross-sectional shape. These support protrusions 288 and 290 are detachably received in the guide channel 256 of the other supporting-guiding member 254. Nearly triangular operating pieces 292 and 294 are provided respectively on the outside surfaces of the end walls 106 and 108 of the first unit frame 105 (the operating piece 292 is shown in FIG. 4, and the operating piece 294 is shown in FIGS. 8 to 10). These operating pieces 292 and 294 act on the holding members 268 of the elevated position holding means 266.

The first unit 102 is mounted on the main body 2 of the image-forming machine by the following procedure.

Figure 8:
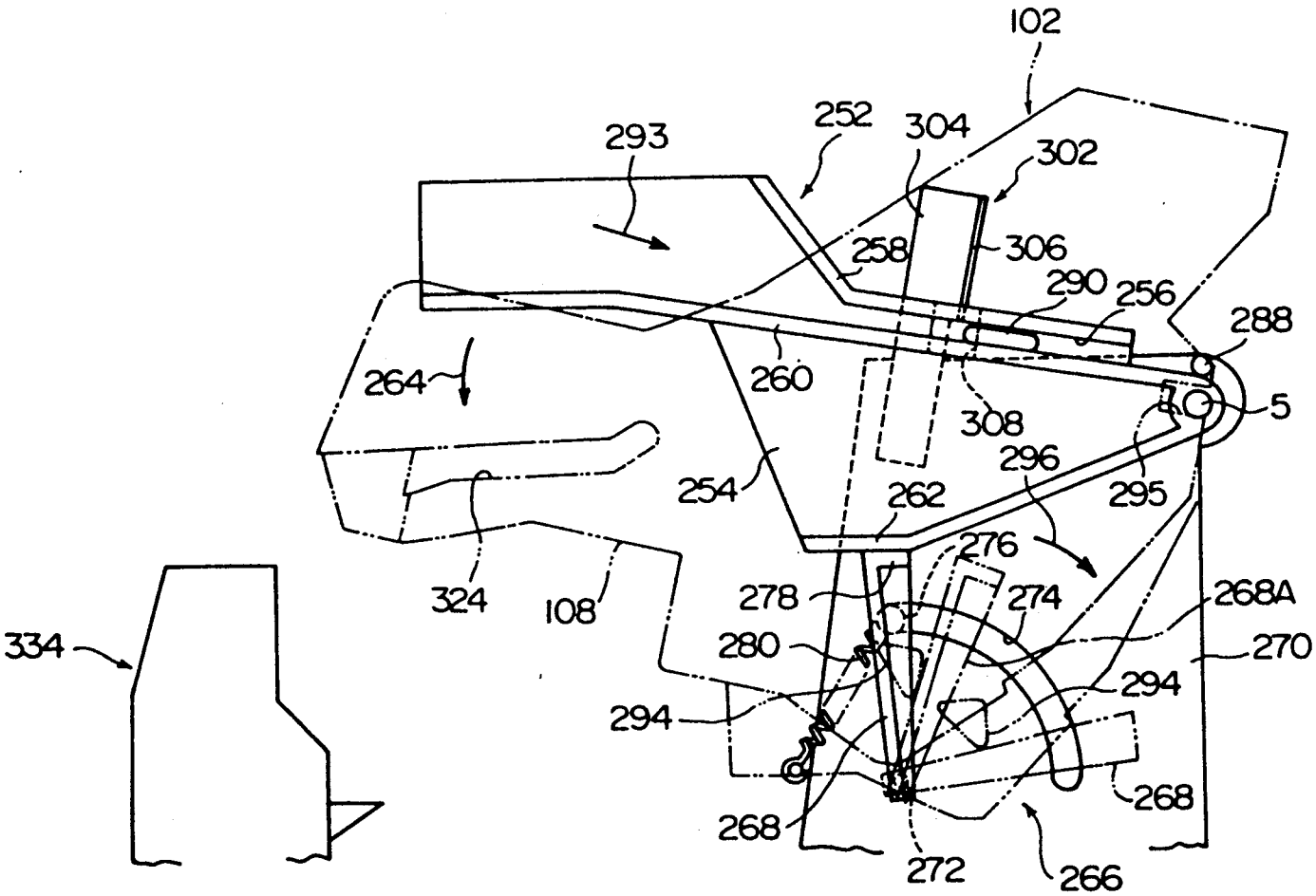
FIG. 8 is an outline view for illustrating the manner of mounting the first unit in the laser beam printer of FIG. 1.
Figure 9:
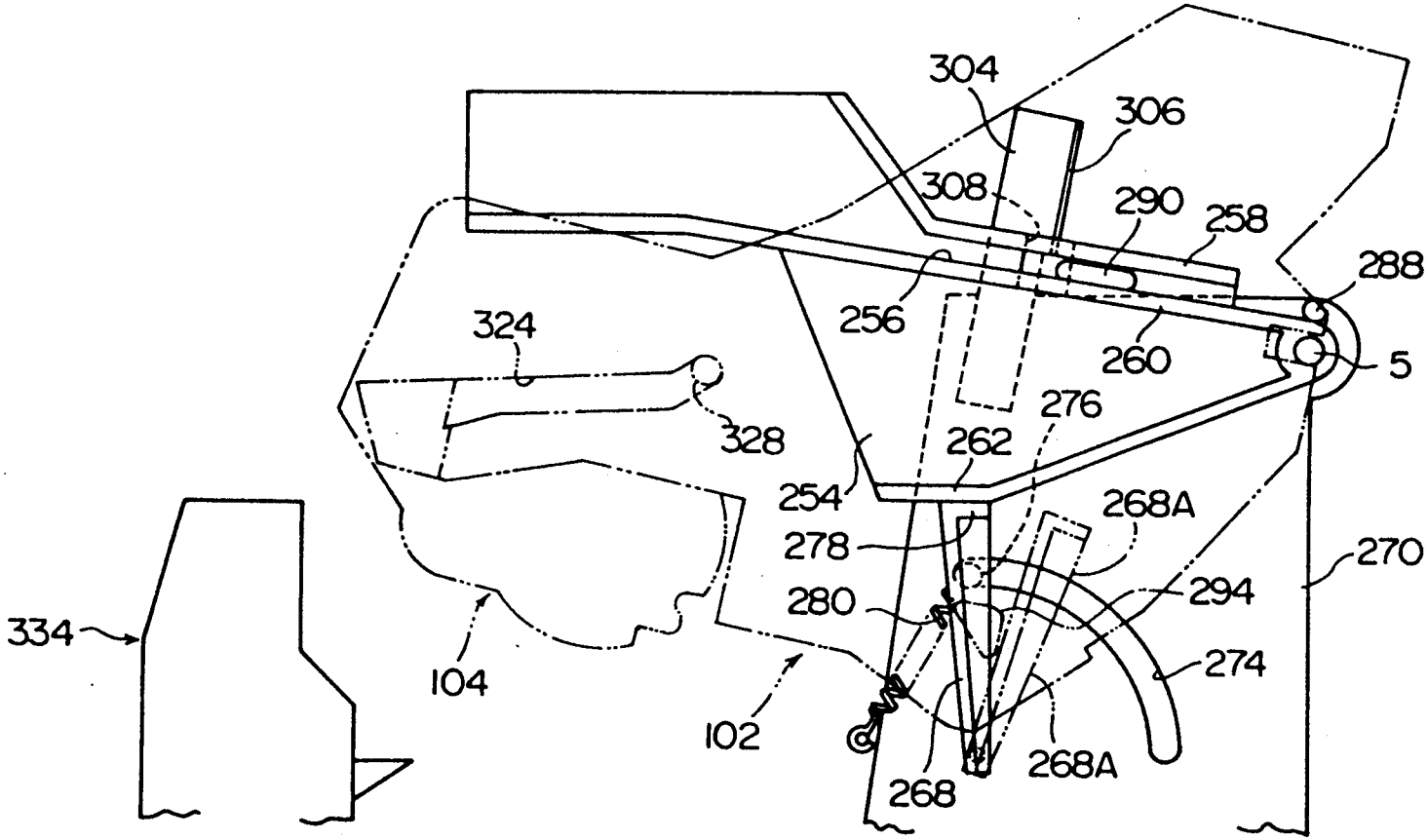
FIG. 9 is an outline view showing the relation between the process unit and a fixation device when in the laser beam printer of FIG. 1, the process unit is mounted on the main body of the printer and a supporting-guiding member is held at an elevated position.

In mounting the first unit 102, the holding members 268 are held at the operative positions shown by the solid lines in FIG. 8 by the action of the biasing spring 280, and thereby the supporting-guiding members 254 are also held at the elevated positions. At the elevated positions, the guide channels 256 defined in the pair of the supporting-guiding members 254 extend toward the open space between the lower housing 4 and the upper housing 6, and therefore, the first unit 102 can be mounted easily as described below.

For mounting, the support protrusions 284 and 286 provided in the end wall 106 in the first unit 102 and the support protrusions 288 and 290 provided in the end wall 108 are positioned on the protruding beams 260 of the corresponding supporting-guiding members 254. Then, the first unit 102 is moved in the mounting direction shown by an arrow 293 (FIG. 8). As a result, the support protrusions 284 and 286 are positioned in the guide channel 256 of one supporting-guiding member 254 and moved along this guide channel 256, and at the same time, the support protrusions 288 and 290 are positioned in the guide channel 256 of the other supporting-guiding member 254 and moved along the guide channel 256. When the first unit 102 is inserted to the position shown by a two-dot chain line in FIG. 8, the shaft 5 is positioned in rectangular notches 295 formed in the end portions (the right end portions in FIGS. 1, 2, 4 and 8) of the end walls 106 and 108 of the first unit frame 105, and comes into contact with the bottom surfaces of the notches 295. As a result, the movement of the first unit 102 in the mounting direction of arrow 293 is hampered, and the first unit 102 is mounted on the main body 2 of the image-forming machine via the shaft 5. In this mounted state, the support protrusions 284 and 288 are positioned beyond the guide channel 256, but the support protrusions 286 and 290 are positioned within the guide channel 256. When the first unit 102 is moved near the position shown by the above two-dot chain line, the operating pieces 292 and 294 of the end walls 106 and 108 act on the holding members 268. Incident to the movement of the first unit 102 in the direction of arrow 293, the holding members 268 are pivoted in the direction shown by an arrow 296 and moved to the position shown by the two-dot chain line. By the operative projecting pieces 292 and 294, the holding members 268 are pivoted from the operative position to the position shown by two-dot chain line 268A in the direction shown by the arrow 296. As a result, the contacting protrusion 262 of the supporting-guiding member 254 is disengaged from the operative projecting portion 278 of the holding member 268 to permit the supporting-guiding member 254 to pivot downwardly in the direction shown by arrow 264. When the first unit 102 so mounted is pivoted downwardly in the direction of arrow 264, the pair of supporting-guiding members 254 are pivoted downwardly together with the first unit 102, and by the action of the operative projecting pieces 292 and 294, the holding members 268 are pivoted in the direction of arrow 296.

In relation to the first unit 102, a detachment hampering means 302 is provided. The detachment hampering means 302 is provided with hampering pieces 304 disposed in correspondence to the pair of supporting-guiding members 254. The hampering pieces 304 are fixed to part of the main body 2 (as shown in FIG. 8, one is fixed to the supporting base plate 270). Hampering portions 306 which can act on the support protrusions 286 and 290 are provided in the upper end portions of the hampering pieces 304. The hampering portion 306 of one hampering piece 304 is disposed in correspondence to a notch (not shown) formed in one supporting-guiding member 254. The hampering portion 306 of the other hampering piece 304 is disposed in correspondence to a notch 308 formed in the other supporting-guiding member 254. When the supporting-guiding members 254 are at the above elevated positions or therebelow, the hampering portions do not project into the guide channels 256 of the supporting-guiding members 254, and therefore, the first unit 102 is permitted to move in the detaching direction (FIG. 8). But when the supporting-guiding members 254 are positioned above the elevated positions (for example, the detached positions shown in FIG. 10), the hampering portions 306 projects into the guide channels 256 through the notches 308 in the supporting-guiding members 254. Accordingly, by the contacting of the support protrusions 286 and 290 with the hampering portions 306, the movement of the first unit 102 in the detaching direction can be accurately hampered (FIG. 10). Because of the above-described arrangement, the pair of supporting-guiding members 254 have to be positioned at the elevated positions or below them when it is desired to detach the first unit 102 from the main body 2 as described below.

Manner of Mounting the Second Unit

Figure 11:
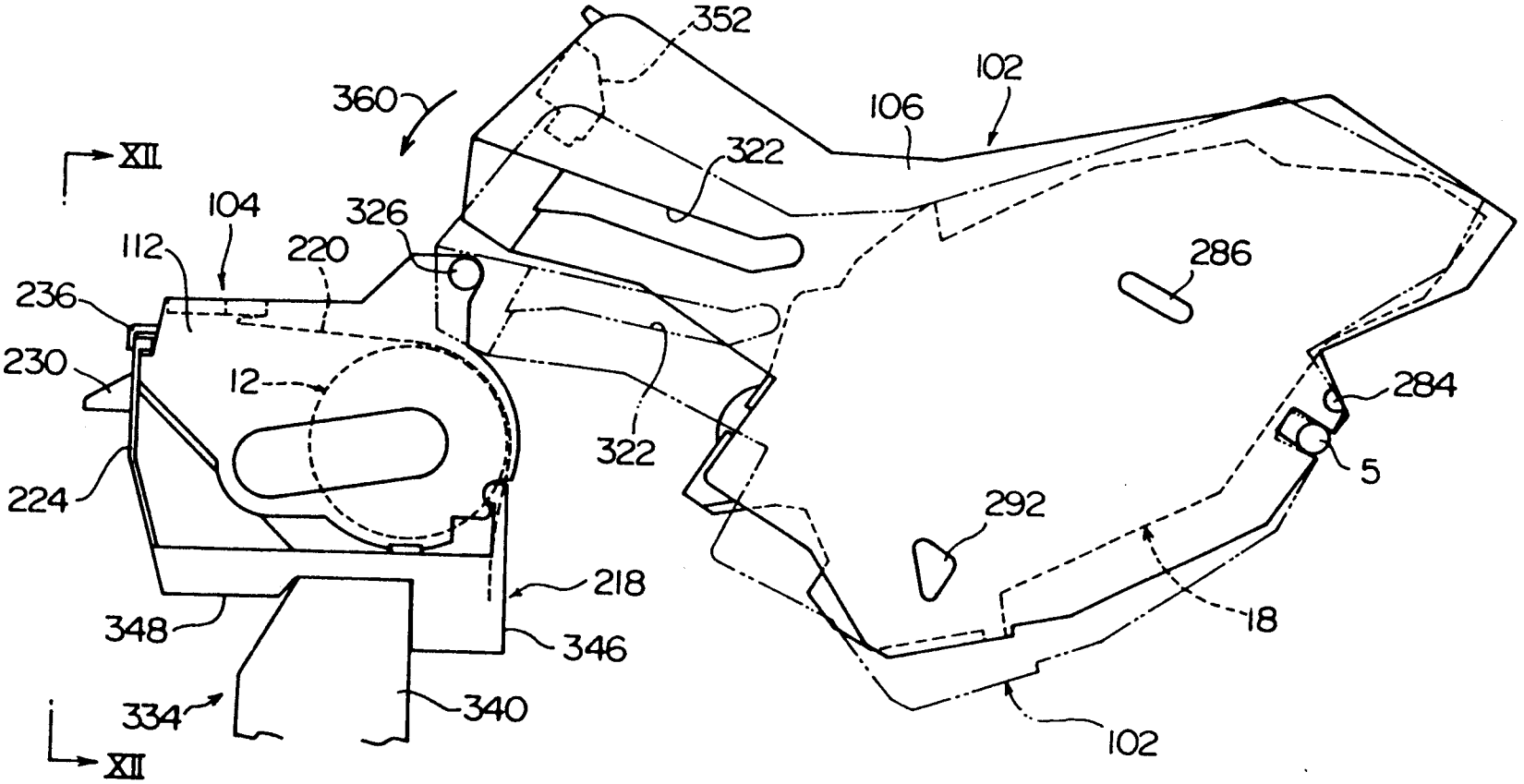
FIG. 11 is an outline view showing that in the laser beam printer of FIG. 1, the second unit is placed on the upper end portion of the fixation device in order to mount the second unit on the first unit.
Figure 12:
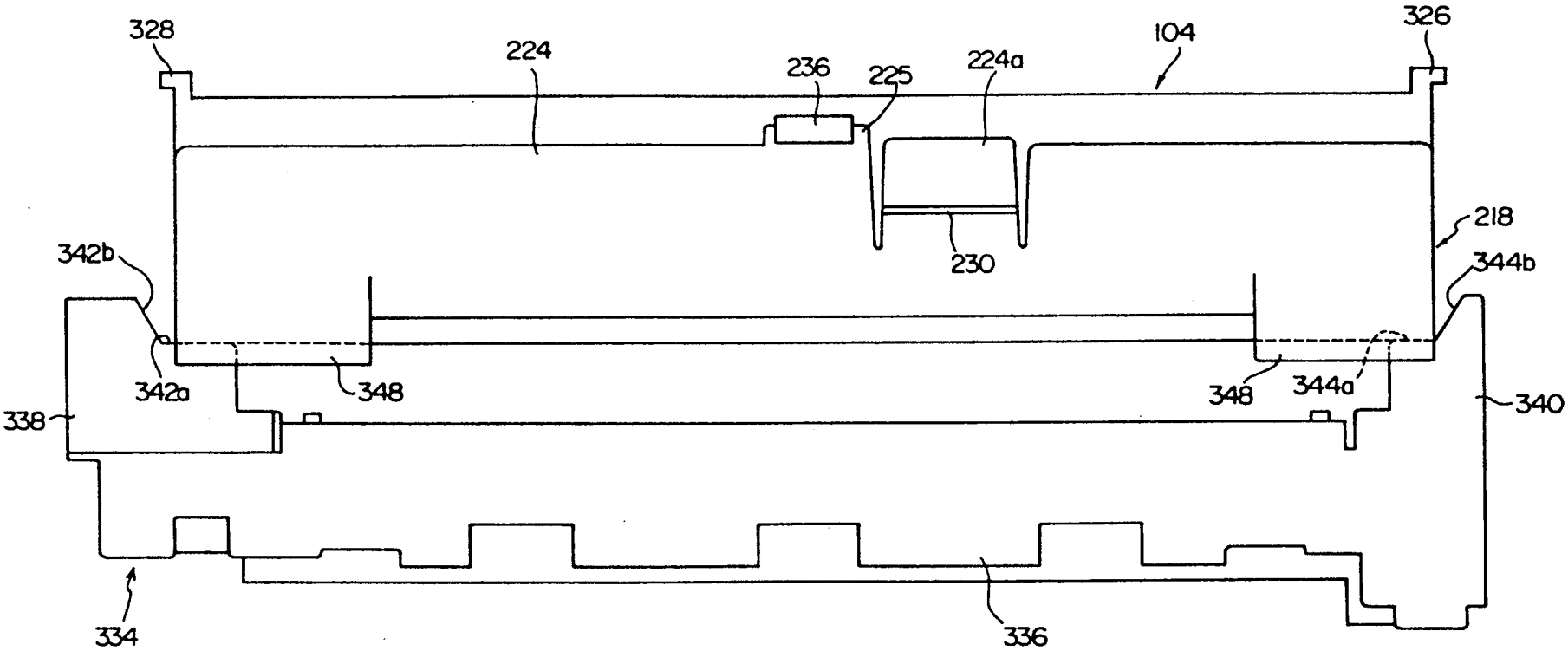
FIG. 12 is a view taken on line XII—XII of FIG. 11.
Figure 13:
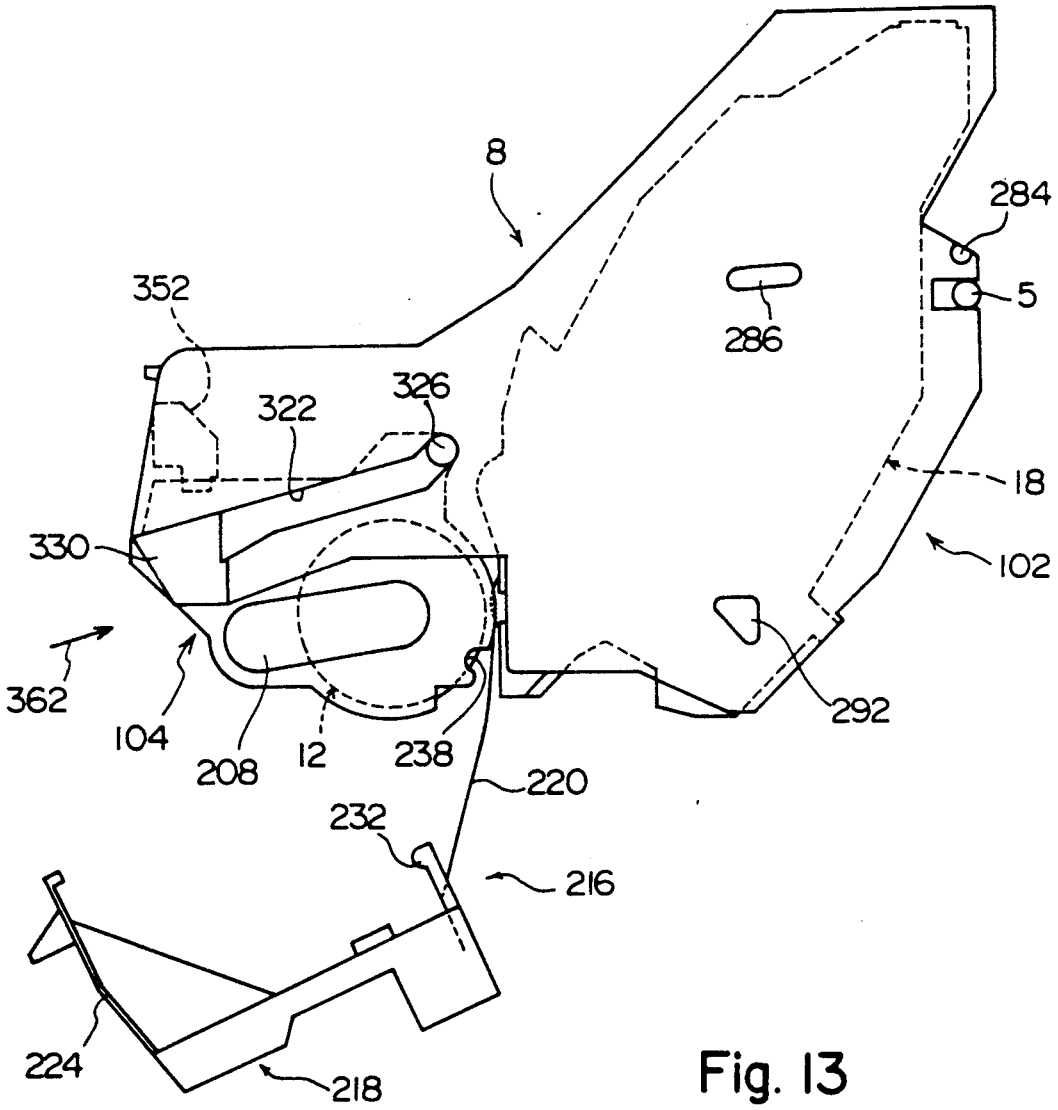
FIG. 13 is an outline view showing that the second unit is mounted on the first unit and then the cover means is removed from the second unit.

With reference to FIGS. 11 to 13 in conjunction with FIGS. 2 and 4, the manner of mounting the second unit 104 on the first unit 102 mounted as described above.

Guide channels 322 and 324 extending from left to right in FIGS. 2, 4 and 11 are formed in the end walls 106 and 108 respectively in the first unit 102 (the guide channel 322 in the end wall 106 is shown in FIGS. 4 and 11, and the guide channel 324 in the other end wall 108, in FIG. 2). One end of each of these guide channels 322 and 324 is open to the left in FIGS. 2 and 11, and its other end portion is upwardly inclined to a slightly greater extent than at the other part.

Short cylindrical protrusions 326 and 328 corresponding to the guide channels 322 and 324 are provided in the end walls 112 and 114 of the second unit 104 (the protrusion 326 in the end wall 112 is shown in FIGS. 4 and 11, and the protrusion 328 of the end wall 114, in FIGS. 2 and 4). These protrusions 326 and 328 are provided at the upper ends of the right end portions of the end walls 112 and 114 respectively, and project toward both sides from the outside surfaces of the end walls.

In mounting the second unit 104 on the first unit 102, the protrusions 326 and 328 are received in the guide channels 322 and 324. In relation to this, outwardly extending projecting wall portions 330 and 332 corresponding to the neighborhoods of the openings of the guide channels 322 and 324 are provided in the end walls 106 and 108 respectively of the first unit 102. The projecting wall portions 330 and 332 are channel-shaped in cross section. In mounting the second unit 104, the protrusions 326 and 328 are positioned in guiding depressions defined by the projecting wall portions 330 and 332, and guided by the inside surfaces of the projecting wall portions 330 and 332 into the guide channels 322 and 324. To facilitate mounting of the second unit 104 and prevent injury to the rotating drum 12 at the time of mounting, the second unit 104 is covered with the cover means 216, and in this state, placed on part of the main body 2, specifically on the upper end portion of a fixing device 334 having the pair of fixing roller 50 (FIG. 1). With reference mainly to FIGS. 11 and 12, placing portions 338 and 340 for supporting the cover member 218 of the cover means 216 mounted on the second unit 104 are provided in the left end portion and the right end portion in FIG. 12 of the fixing device 334. One placing portion 338 is comprised of a supporting member mounted on the upper end portion of the main body 336 of the fixing device, and the other placing portion 340 is comprised of part of the upper end portion of the main body 336 of the fixing device. The placing portions 338 and 340 are of substantially the same shape and have substantially flat placing surfaces **342*a* and 344*a* and outside inclined surfaces 342*b* and 344*b* inclined upwardly outwardly from the outside ends of the placing surfaces 342*a* and 344*a*. On the other hand, a pair of projecting portions 346 and 348 spaced from each other in the left-right direction in FIG. 11 (in the direction from left bottom to right top in FIG. 4) are provided at both end portions of the bottom wall 222 of the cover member 218 of the cover means 216, and that part of the bottom wall 222 which is between the pair of projecting portions 346 and 348 is substantially flat. The inside surface of one projecting portions 346 (the right one in FIG. 11) corresponds in shape to the right surface in FIG. 11 of each of the placing portions 338 and 340, and extends downwardly substantially perpendicularly from the under surface of the bottom wall 222. The inside surface of the other protruding portion 348 corresponds in shape to the left surface in FIG. 11 of each of the placing portions 338 and 340, and extends inclinedly to the left in FIG. 11 downwardly from the under surface of the bottom wall 222. The cover member 218 mounted on the second unit 104 is placed on the placing portions 338 and 340 of the fixing device 334 as shown in FIGS. 11 and 12. Specifically, that part of the cover member 218 which is between the projecting portions 346 and 348 at its both end portions is placed on the placing surfaces 342*a* and 344*a* of the placing portions 338 and 340. In this placed state, both ends of the bottom wall 222 of the cover member 218 are positioned inwardly of the outside inclined surfaces 342*b* and 344*b* of the placing portions 338 and 340, and the movement of the cover member 218 in the left-right direction in FIG. 12 is restrained by the outside inclined surfaces 342*b* and 344*b*. The projecting portions 346 and 348 provided at both end portions of the bottom wall 222 are positioned on both sides of the placing portions 338 and 340, and consequently, the movement of the cover member 218 in the left-right direction in FIG. 11 (the direction perpendicular to the sheet surface in FIG. 12) is restrained by the projecting portions 346 and 348. Accordingly, by placing the cover member 218 on the placing portions 338 and 340, the second unit 104 can be positioned at a predetermined position with respect to the first unit 102 mounted on the main body 2 of the image-forming machine. Since the outside inclined surfaces 342*b* and 344*b* are provided in the placing portions 338 and 340 and the left surfaces in FIG. 11 of the placing portions 338 and 340 are inclined, the cover member 218 mounted on the second unit 104 can be easily placed on the placing surfaces 342*a* and 344*a* of the above placing portions 338 and 340**.

Furthermore, a locking means is provided to lock the first unit 102 and the second unit 104 releasably. With reference to FIGS. 3 and 4, the locking means has a pair of engaging members 352 which are provided in the left end portion in FIG. 4 of the upper wall 110 of the first unit frame 105. The pair of engaging members 352 are arranged opposite to each other and spaced from each other in the width direction (the direction from right bottom to left top in FIG. 4) of the first unit frame 105 and are mounted pivotally via a pin. One end portion of each engaging member 352 projects downwardly of the upper wall 110, and a claw portion 354 is provided in this one end portion. The other end portion of each engaging member 352 projects upwardly of the upper wall 110 and this projecting end portion functions as an operative portion. On the other hand, in correspondence to the provision of the engaging members 352 in the first unit 102, a pair of rectangular openings 356 (particularly FIG. 4) spaced from each other in the width direction (the direction from right bottom to left top in FIG. 4) are formed in the upper wall 116 of the second unit 104. When the second unit 104 has been mounted on the first unit 102, the claw portions 354 of the engaging members 352 project downwardly through the openings 356 formed in the upper wall 116 of the second unit frame 107. By the engagement of these claw portions 354 with those sites of the upper wall 116 which define the openings 356, the first unit 102 and the second unit 104 are locked releasably via the locking means. In correspondence to each engaging member 354, a biasing spring 358 is provided which biases each engaging member 352 toward the opening 356 in the upper wall 116. Accordingly, the biasing springs 358 maintain the claw portions 354 of the engaging members 352 in engagement with the openings 356.

The second unit 104 is mounted on the first unit 102 mounted on the main body 2 of the image-forming machine, by the following procedure.

To mount the second unit 104 on the first unit 102, the first unit 102 is pivoted upwardly about the shaft 5 as a center as shown by a solid line in FIG. 11 (for example, until the supporting-guiding members 254 come near the above detached positions). Then, as shown in FIGS. 11 and 12, the second unit 104 covered with the cover means 216 is placed in position on the placing portions 338 and 340 provided in the upper end portion of the fixing device 334. This placing is affected by positioning that part of the cover member 218 which exists between the projecting portions 346 and 348 at both end portions at the placing surfaces 342*a* and 344*a* of the placing portions 338 and 340. This positioning results in positioning the second unit 104 in a predetermined positional relationship with respect to the first unit 102 mounted on the main body 2 of the image-forming machine.

In the next place, the first unit 102 is pivoted downwardly in the direction shown by an arrow 360. As a result, the upper ends of the projecting wall portions 330 and 332 of the first unit frame 105 make contact with the protrusions 326 and 328 of the second unit frame 107, and as the first unit 102 pivots downwardly, the action of the projecting wall portions 330 and 332 leads the protrusions 326 and 328 to the guide channels 322 and 324 formed in the end walls 106 and 108 of the first unit frame 105. Accordingly, by simply pivoting the first unit 102 downwardly, the protrusions 326 and 328 of the second unit 104 are detachably received in the guide channels 322 and 324 of the first unit 102.

Then, the second unit 104 covered with the cover means 216 is lifted from the fixing device 334, and moved in the mounting direction shown by arrow 362 (FIG. 13). As a result, the protrusions 326 and 328 of the second unit 104 move within and along the guide channels 322 and 324 of the first unit frame 105. When the protrusions 326 and 328 move to the bottoms of the guide channels 322 and 324 shown in FIG. 13, the second unit 104 is moved to a predetermined mounting position with respect to the first unit 102.

Thereafter, the second unit 104 is pivoted slightly upwardly to the position shown by a solid line in FIG. 13 about the protrusions 326 and 328 as a center, whereupon the claw portions 354 of the engaging members 352 in the locking means project downwardly through the openings 356 of the upper wall 116 of the second unit frame 107. When the claw portions 354 engage the sites defining the openings 356, the first unit 102 and the second unit 104 are locked releasably in a predetermined positional relationship.

After this detachable locking, the cover means 216 mounted on the second unit 104 is removed from the second unit 104 in the manner described hereinabove, as shown in FIG. 13. As a result, the constituent elements (including the developing device 18) mounted on the first unit frame 105 and the constituent elements (including the rotating drum 12 and the cleaning device 22) mounted on the second unit frame 107 are maintained in the positional relationship shown in FIG. 2, and the first unit 102 and the second unit 104 constitute the process unit 8.

Since the cover means 116 is detached from the second unit 104 after the second unit 104 is mounted on the first unit 102, the rotating drum 12 is accurately prevented from undergoing damage during the mounting of the second unit 104.

Again with reference to FIGS. 9 and 10, when the supporting-guiding members 254 are held at the above-described elevated positions and an attempt is made to detach the first unit 102 from the second unit 104 which is mounted on the first unit 102, the bottom portion of the second unit 104 makes contact with the upper portion of the fixing device 334 as can be seen from FIG. 9. Accordingly, the proper detaching operation cannot be performed, and the second unit 104 cannot be detached from the first unit 102. On the other hand, when the first unit 102 is pivoted so that the supporting-guiding members 254 move upwardly from the above elevated positions to the above detached positions, the second unit 104 is positioned above the fixing device 334 as shown in FIG. 10. Hence, the second unit 104 can be detached from the first unit 102 as described below. At the detached positions, the hampering portions 306 of the hampering pieces 304 project into the guide channels 256 of the supporting-guiding members 254, and by the contacting of the support protrusions 290 with the hampering portions 306, the detachment of the first unit 102 from the main body 2 of the image-forming machine is accurately hampered. Accordingly, in the illustrated laser beam printer, the first unit 102 and the second unit 104 mounted on each other cannot substantially detached from the main body 2 of the printer. To detach the process unit 8, it is necessary to detach the second unit 104 from the first unit 102 while the supporting-guiding members 254 are held at the detached positions, and then to detach the first unit 102 from the main body 2 of the printer while the supporting-guiding members 254 are held at the elevated positions.

The laser beam printer in the illustrated embodiment are constructed such that the photosensitive member of the rotating drum 12 substantially comes to the end of its service life when 2500 images have been formed, and the toner loaded into the development housing 126 of the developing device is substantially consumed when 10000 images have been formed. Hence, the second unit 104 must be replaced four times during one replacement of the first unit 102. At the time of replacement, it is necessary only to detach the second unit 104 from the first unit 102. Consequently, only a small portion may be detached at the time of replacing the rotating drum 12, and the detaching operation is easy. Moreover, scattering of the developer does not occur at the time of detachment.

The developing device 18 mounted on the first unit frame 105 will be described further with reference to FIGS. 14-A and 14-B. The left end portion in FIGS. 2 and 14-A of the developing device 18 is mounted swingably across the end walls 106 and 108 of the first unit frame 105 via a shaft 372. A biasing spring 374 is interposed between the development housing 126 of the developing device 18 and the first unit frame 105. Pins 376 are implanted in both end surfaces of the development housing 126. Pins 378 are implanted in the inside surfaces of the end walls 106 and 108 of the first unit frame 105. The biasing spring 374 is engaged between the pin 376 and the pin 378. The biasing spring 374 biases the developing device 18 clockwise in FIGS. 14-A and 14-B with the shaft 372 as a center.

Accordingly, when the second unit 104 is not mounted on the first unit 102, the developing device 18 is biased in the direction shown by an arrow 380 by the action of the biasing spring 374. The upper end portion of the developing device 18 makes contact with a contacting wall portion 382 (see FIG. 2 also) provided between the upper end portions of the end walls 106 and 108 and is held at the position shown in FIG. 14-A. In contrast, when the second unit 104 is detachably mounted on the first unit 102, the opposite end portions of the rotating drum 12 act on rollers 384 provided at the opposite ends of the sleeve 140 of the magnetic brush mechanism 138 to swing the developing device 18 counterclockwise in FIG. 14-B against the biasing action of the biasing spring 374. Hence, the rollers 384 are kept in press contact with the rotating drum 12 by the biasing spring 374 and the own weight of the developing device 18, and the distance between the surface of the sleeve 140 of the magnetic brush mechanism 138 and the surface of the rotating drum is accurately maintained at a predetermined value.

Driving Coupling

With reference to FIGS. 15 and 16 when the process unit 8 is mounted in position on the main body of the laser beam printer, the short rod (shaft portion) 180 disposed at one end portion of the rotating drum 12 in the process unit 8 is supported on a receiving means 402 provided in the upper housing 4 of the main body 2. The receiving means 402 is comprised of a main body portion 406 having a nearly U-shaped depression 404 formed therein and a securing portion 408 disposed in the rear end of the main body portion 406. The securing portion 408 is secured to the inside surface of a rear upstanding base plate 412 of the lower housing 4 by means of a setscrew 410. The depression 404 extends downwardly from the upper surface of the main body portion 406, and its nearly semicircular bottom surface defines a receiving surface 414 supporting the short rod 180 of the rotating drum 12. With reference to FIGS. 17-A and 17-B also, one end portion (the left end portion in FIGS. 17-A and 17-B) of the receiving surface 414 which comes into contact with the peripheral surface of the short rod 180 extends slightly upwardly of a horizontal H passing through the center of the short rod 180 when the short rod 180 is supported on the receiving surface 414. Hence, one end portion of the receiving surface 414 supports the short rod 180 by contacting even part of the upper portion of the short rod 180. An escape portion 416 is provided in the other end portion (the right end portion in FIGS. 17-A and 17-B) of the receiving surface 414. The escape portion 416 is formed by progressively decreasing the curvature of the inside surface defining the depression 404 toward the opening side. Alternatively, it can be formed by forming a notch or the like.

With reference to FIGS. 15 and 16, the rotating drum 12 is earthed via the receiving means 402 and the rear upstanding base plate 412. The end wall member 174 (FIG. 5) and the short rod 180 disposed in one end portion of the rotating drum 12 are formed of a metallic material such as steel. The rear upstanding base plate 412 of the lower housing 4 is formed of an iron plate, and the receiving means 402, from a sintered copper alloy. Accordingly, when the process unit 8 is mounted in position, the short rod 180 of the rotating drum 12 is supported on the receiving means 402 and the rotating drum 12 is electrically connected to the lower housing 4 via the short rod 180 and the receiving plate 402. To ensure the electrical connection between the rotating drum 12 and the lower housing 4, an electrically conductive spring member 418 may be provided in the receiving means 402. The spring member 418 can be formed of, for example, phosphor bronze, and as shown in FIG. 16, is secured to the securing portion 408 by the setscrew 410. One end portion of the spring member 418 projects into the depression 404 through an opening formed in the main body portion 406, and elastically pressed against the end surface of the short rod 180 supported on the receiving member 402.

Now, with reference to FIG. 18 in conjunction with FIG. 15, an upstanding auxiliary base plate 420 (FIG. 15) is also disposed in the lower housing 4, and a driving system is provided in the auxiliary base plate 420. The driving system includes a driving source 422 which may be a reversible electric motor. An output gear 424 is fixed to the output shaft of the driving source 422 and drivingly coupled to a driving coupling gear 430 via a twin gear 426 and a twin gear 428. More specifically, the output gear 424 is in mesh with a large gear 432 of the twin gear 426, and a small gear 434 of the twin gear 426 is in mesh with a large gear 436 of the twin gear 428. A small gear 438 of the twin gear 428 is in mesh with the driving coupling gear 430.

In the process unit 8, the gear 178 provided at one end portion of the rotating drum 12 is in mesh with a gear 440 which in turn is in mesh with a gear 442. The gear 440 is connected to the sleeve 140 of the magnetic brush mechanism 138 provided in the development housing 126 of the developing device 18. The gear 442 is connected to the agitating member 148 disposed within the development housing 126 (see FIG. 2 also). The gear 178 provided at one end portion of the rotating drum 12 is also connected to the gear 202 via the gear 206 as already stated with reference to FIG. 5. The gear 202 is connected to the toner transferring means 154 in the cleaning device 22.

When the process unit 8 is mounted in position on the main body 2 of the printer, the driven gear 178 of the process unit 8 is connected to the driving coupling gear 430 of the main body 2 to connect the various elements to be driven in the process unit 8 to the driving source 422. When the driving source 422 is driven in a normal direction shown by the arrow in a solid line, the gear 178 (the rotating drum 12), the gear 440 (the sleeve 140 of the magnetic brush mechanism 138), the gear 442 (the agitating member 148) and the gear 202 (the toner transferring means 164) are rotated in the direction shown by the arrow in a solid line. When the driving source 422 is rotated in an inverse direction shown by the arrow in a broken line, the gear 178 (the rotating drum 12), the gear 440 (the sleeve 140 of the magnetic brush mechanism 138), the gear 442 (the agitating member 148) and the gear 202 (the toner transfer means 164) are rotated in the direction shown by the arrow in a broken line.

Again with reference to FIG. 17-A, when the gear 178 of the process unit 8 is in mesh with the gear 430 of the main body 2 of the printer and straight line P connecting the center of the gear 178 to the center of the gear 430 is inclined at some angle $\alpha$ (in the illustrated embodiment, $\alpha$ is about 6 degrees) counterclockwise in FIG. 17-A with respect to a substantially vertical straight line V, the transmitting force F to be transmitted to the rotating drum 12 upon the normal rotation of the driving source 422 is directed in the direction shown by the arrow in a solid line in FIG. 17-A. More specifically, the acting direction of the transmitting force F is generally the direction of revolution of the gear 430 from straight line P about the center of the gear 178, that is, the direction of clockwise revolution of the gear 430 by an angle $(90+\beta)$ resulting from addition of the pressure angle $\beta$ of the large gear 106 to 90 degrees when the driving source 422 is rotated in the normal direction. For example, when the gear 178 has a pressure angle $\beta$ of 20 degrees, it is the direction shown by the arrow in a solid line in FIG. 17-A, namely the direction revolved clockwise by an angle of 14 degrees upwardly from the horizontal straight line H. On the other hand, in the illustrated embodiment, one end of the receiving surface 414 of the receiving means 402 extends from the horizontal straight line H to an angular position of substantially 60 degrees upwardly in the clockwise direction in FIG. 17-A, and the other end of the receiving means 402 extends to an angular position of substantially 180 degrees downwardly in the counterclockwise direction in FIG. 17-A from the above one end. Accordingly, the transmitting force F transmitted to the gear 178 acts on the short rod 180 as acting force F'. The acting force F' biases the short rod 180 in a direction in which it bites into the receiving surface 414 of the receiving means 402. Thus, by the action of this transmitting force, the short rod 180 and the receiving surface 414 are always kept in contact with each other, and the rotating drum 12 and the process unit 8 are held accurately at predetermined positions. To ensure supporting of the short rod 180, it is critical, as can be easily seen from FIG. 17-A, to make one end of the receiving surface 414 extend clockwise beyond the direction in which the transmitting force F acts.

On the other hand, when the driving source 422 is rotated inversely by exercising the following control, the transmitting force F transmitted to the rotating drum 12 is directed in the direction shown by the arrow in a solid line in FIG. 17-B. More specifically, the acting direction of the transmitting force F is the direction of revolution of the gear 430 about the center of the gear 178 from the straight line P, namely the direction of revolution of gear 430 by an angle $(90+\beta)$ resulting from addition of the pressure angle $\beta$ of the gear 178 to 90 degrees counterclockwise when the driving source 422 is rotated inversely. In the illustrated embodiment, it is the direction revolved by an angle of 26 degrees counterclockwise in FIG. 17-B from the horizontal straight line H. On the other hand, in the illustrated embodiment, the other end of the receiving surface 414 of the receiving means 402 exists only to an angular position substantially 60 degrees revolved downwardly in the counterclockwise direction in FIG. 17-B from the horizontal straight line H, and following this other end, the escape portion 416 is provided. Accordingly, when the rotating drum 12 is rotated in a direction opposite to the direction of arrow 14 (FIG. 2), the transmitting force F transmitted to the gear 178 acts on the short rod 180 as an acting force F', and by the acting force F', the short rod 180 is biased in the direction in which it moves toward the escape portion 416 from the receiving surface 414 of the receiving means 402. Consequently, the short rod 180 is slightly moved to the escape portion 416 as shown by a two-dot chain line in FIG. 17-B to permit the short rod 180 to be detached easily from the receiving means 402. Because the transmitting force transmitted to the gear 178 from the gear 430 acts only on one end portion of the rotating drum 12, it is sufficient to dispose the receiving means 402 in relation to the short rod 180, and there is no need to dispose a receiving means in the main body 2 of the printer in relation to the other end portion (front end portion) of the rotating drum 12.

Control of Driving

With reference to FIG. 19 showing part of a control system of the laser beam printer in a simplified manner, the control system includes a control means 450 which may be a microprocessor. The operating panel (not shown) of the printer has disposed therein a main switch 452 and a start switch 454 for stating the step of image formation. The printer further has disposed therein an end signal forming means 456 for feeding an end signal to the control means 450 when the image-forming step comes to an end, a detecting means 458 for feeding a jamming signal to the control means 450 when a sheet material jamms up in the conveyor passage 54, and a safety means 460 for feeding an operation prohibiting signal to the control means 450 when the printer is not ready for a particular required action) (for example, when the upper housing 6 is at the open position). The control means 450 comprises a first timer 462, a second timer 464 and a third timer 466.

When the start switch 454 is closed while the main switch 452 is closed, the control means 450 produces an inverse rotation signal, and simultaneously, the first timer 462 starts counting. When the first timer 462 has counted a predetermined period of time (which may be, for example, about 50 msec), the control means 450 produces a normal rotation signal instead of the inverse rotation signal, whereupon the driving source 422 is rotated normally and the image-forming step is started. While the control means 450 is producing an inverse rotation signal before starting the image-forming step, the driving source 422 is rotated inversely. The following fact should be noted with respect to the inverse rotation of the driving source 422.

With reference to FIG. 2, when the driving source is inversely rotated, the rotating drum 12 is rotated in a direction opposite to the direction shown by arrow 14, and the sleeve 140 in the developing device 18 is rotated in a direction opposite to the direction shown by arrow 144. Furthermore, the agitating member 148 in the developing device 18 is rotated in a direction opposite to the direction of arrow 152. When the sleeve 140 is rotated in the above-mentioned opposite direction, a pool of the developer (resulting from the previous developing) existing between the surface of the sleeve 140 and the free end portion of the blade 146 kept in press contact with the sleeve surface is moved from the contacting site P between the blade 146 and the sleeve 140 and its vicinity as the sleeve 140 moves. Together with the pool of the developer, foreign matter (including dirt) interposed between the blade 146 and the sleeve 140 is moved and can be effectively removed from between the blade 146 and the sleeve 140. The distance over which the sleeve 140 moves in the above opposite direction is one sufficient to move the foreign material substantially out of the acting area of the blade 146. This distance slightly varies with the press-contacting force of the blade 146, but is preferably half of, or less than, the above projecting amount l of the blade 146, for example 1 to 3 mm or more. If the amount of revolution of the sleeve 140 in the opposite direction is small, the foreign matter cannot be sufficiently removed from between the blade 146 and the sleeve 140. On the other hand, if the amount of revolution of the sleeve 140 becomes excessively large, the developer in the development housing 126 is conveyed toward the developing zone 139 after passing between the sleeve 140 and the leakage preventing member 143, and may cause leakage or scattering of the developer. Accordingly, the distance over which the sleeve 140 revolves is preferably less than the distance between the supply pole $N_2$ and the conveying pole $S_2$ so that the developer held onto the sleeve 140 in the supply zone 141 by the action of the supply pole $N_2$ is not conveyed beyond the conveying pole $S_2$. In the case of a magnetic brush mechanism of the type in which a permanent magnet is revolved instead of the sleeve for the movement of the developer, the permanent magnet can be rotated slightly in a direction opposite to an ordinary rotating direction before the start of the image-forming step.

In the cleaning device 22, when the rotating drum 12 is rotated in the opposite direction, foreign matter (such as paper dust of the sheet material and a solidified toner) gathering between the tip portion of the elastic blade 158 of the cleaning device 22 and the surface of the rotating drum 12 is moved away from the elastic blade 158 with the movement of the rotating drum 12, and goes out of the acting zone of the elastic blade 158. Thus, the tip portion of the elastic blade 158 comes directly in contact with the surface of the rotating drum 12, and poor cleaning and injury to the photosensitive member can be avoided. The distance over which the rotating drum 12 revolves in the opposite direction is one sufficient to move the foreign matter gathering between the rotating drum 12 and the elastic blade 158 substantially out of the acting area of the elastic blade 158. It differs slightly with the properties of the elastic blade 158, but may be about 5 to 15 mm. If this distance is small, the foreign matter remains interposed between the rotating drum 12 and the elastic blade 158. If, on the other hand, the distance is large, the elastic blade 158 is elastically deformed downwardly comparative greatly and strongly acts on the surface of the rotating drum 12. This may become the cause of deformation of the elastic blade 158.

Now, a controlling operation for stopping the rotation of the rotating drum 12 in an ordinary direction shown by arrow 14 will be described with reference to a flow chart shown in FIG. 20. In step n-1, it is determined whether any of a stop signal for stopping the driving force 422 (i.e., the signal showing the end of the image-forming step), a jamming signal and an operation prohibiting signal is produced. When the stop signal is not produced, a routine of the image-forming step is performed. On the other hand, when either one of the stop signal, jamming signal and the operation prohibiting signal is produced, step n-1 goes to step n-2. In step n-2, it is determined whether the third timer 466 has counted up the time or not. If not, it is determined in step n-3 whether or not the second timer 464 has counted up the time. When either one of the stop signal, the jamming signal and the operation prohibiting signal is produced, the second timer 464 and the third timer 466 have not yet been set, and therefore, step n-1 goes to step n-4 via steps n-2 and n-3. In step n-4, it is determined whether or not an inverse rotation signal is produced or not. When either the stop signal, the jamming signal or the operation prohibiting signal is produced, the above inverse rotation signal has not been produced. Thus, step n-4 goes to step n-5. In step n-5, the normal rotation signal produced by the control means 450 is erased. Then, instep n-6, the control means 450 produces the inverse rotation signal. As will be described below, this inverse rotation signal is fed into the driving source 422 when the second timer 464 has counted up the time. Then in step n-7, the second timer 464 is set, and the time counting of the second timer 464 is started. Then in step n-8, the normal rotation of the driving source 422 is stopped. After step n-8, step n-1 is resumed, and via steps n-1 to n-3, step n-4 sets in. Since the inverse rotation signal is produced in step n-6, step n-4 directly returns to step n-1, and the above operation is repeatedly performed until the second timer 464 counts a predetermined period of time. The predetermined period of time counted by the second timer 464 is the time required from the time when the driving source 422 is deenergized until its rotation completely comes to a stop, and is, for example, about 50 msec.

When the second timer 464 has counted the predetermined period of time, step n-3 goes to step n-9, and the inverse rotation signal produced in the control means 450 is fed into the driving source 422 to rotate the driving source 422 inversely. Then, in step n-10, the second timer 464 is cleared. Thereafter, the third timer 466 is set in step n-11. When step n-11 is over, step n-1 is resumed, and steps n-1 to n-4 are repeated until the third timer 466 counts up a predetermined period. The driving source 422 continues to rotate inversely. The predetermined period of time counted by the third timer 464 is the time required for substantially cancelling the meshing of the gear 178 of the rotating drum 12 with the gear 430 of the main body 2 of the printer (in other words, the time required for moving of the gear 178 to the amount of the backlash between the gear 430 and the gear 178), or the time required for bringing the gears 178 and 430 into mesh with each other after the cancelling of the above engagement and rotating the rotating drum 12 to some extent in a direction opposite to the direction of arrow 14. For example, it is about 50 msec.

When the third timer 466 has counted the predetermined period of time, step n-2 goes to step n-12, and the feeding of the inverse rotation signal from the control means 450 is stopped to stop the inverse rotation of the driving source 422. Furthermore, in step n-13, the third timer 466 is cleared, and in step n-14, the stop signal is erased. Then, in step n-15, the inverse rotation signal produced in the control means 450 is also erased.

Accordingly, when the driving source 422 is deenergized upon the production of the stop signal, the driving source 422 is rotated, for the predetermined period of time counted by the third timer 466, in a direction opposite to the rotating direction in which it rotates during image formation. Hence, during the image formation, the gear 178 of the rotating drum 12 and the gear 430 of the main body 2 of the printer are fully in mesh with each other, but by the inverse rotation of the driving source 422 to some extent in the above manner, the meshed state between the gears 178 and 430 is substantially cancelled, or the two gears are weakly in mesh with each other. Furthermore, the short rod 180 of the rotating drum 12 moves to the escape portion 416 of the receiving means 402. As a result, the process unit 8 on which the rotating drum 12 is mounted can be very easily detached from the main body 2 of the printer.

In addition, during the inverse rotation of the driving source 422 to some extent after stopping of its normal rotation, the above technical advantages can be achieved in the developing device 18 and the cleaning device 22 as in the case of some inverse rotation of the driving source 422 before the starting of its normal rotation.

While one embodiment of the laser beam printer as one example of the image-forming machine of the invention has been described with reference to the accompanying drawings, it should be understood that the invention is not limited to this specific embodiment, and various changes and modifications are possible without departing from the scope of the invention described and claimed herein.

What we claim is:

1. An image-forming machine comprising a main body and a process unit adapted to be detachably mounted on the main body, said process unit including an image-bearing means having a photosensitive means on its surface and a developing device for developing a latent electrostatic image formed on the surface of the photosensitive member; in which the process unit is comprised of a first unit on which the developing device is mounted and a second unit on which the image-bearing means is mounted, the first unit and the second unit can be mounted on, and detached from, each other, and in detaching the process unit mounted on the main body, the first unit cannot be detached from the main body unless the second unit is detached from the first unit and removed from the main body.

2. The image-forming machine of claim 1 in which the main body of the machine is comprised of a lower housing and an upper openable-closable housing mounted on the lower housing such that it is free to pivot between an open position and a closed position about a central pivot axis, the main body of the machine further has mounted thereon a supporting-guiding means in such a manner that it is free to pivot from a lowered position to a detached position via an elevated position, the first unit is adapted to be detachably mounted on the main body of the machine along the supporting-guiding means, a detachment hampering means is provided in relation to the first unit and the supporting-guiding means, said hampering means acting on part of the first unit and hampers detachment of the first unit from the main body of the machine when the supporting-guiding means is at the detached position, and the second unit and the supporting-guiding means are so constructed that when the supporting-guiding means is at the elevated position, an effort to detach the process unit from the main body of the machine results in the contacting of part of the second unit with part of the main body of the machine.

3. The image-forming machine of claim 2 in which the supporting-guiding means has a pair of supporting-guiding members mounted for free pivoting between the detached position and the lowered position about the central pivot axis, guide channels extending in the mounting direction of the first unit are defined in the pair of supporting-guiding members, the first unit has provided therein support protrusions corresponding to the guide channels of the pair of supporting-guiding members, the detachment hampering means has a hampering piece provided in correspondence to at least one of the supporting-guiding members, when the pair of supporting-guiding members are at the detached position, the hampering piece projects into the guide channels, and by the contacting of the support protrusions with the hampering piece, the detachment of the first unit from the main body of the machine is hampered, and when the pair of supporting-guiding members are at the elevated position, the hampering piece recedes from the guide channel to permit the first unit to be detached from the main body of the machine.

4. The image-forming machine of claim 2 in which an elevated position holding means is provided to hold the pair of supporting-guiding members releasably at the elevated position.

5. The image-forming machine of claim 4 in which the elevated position holding means has holding members which are free to pivot between an operative position at which they act on the pair of supporting-guiding members to hold them at the elevated position and a non-operative position at which they do not substantially act on the pair of supporting-guiding members, and when the first unit is mounted along the pair of supporting-guiding members while the holding members are at the operative position and hold the pair of supporting-guiding members, part of the first unit acts on the holding members at the operative position and pivot them toward the non-operative position, thereby cancelling the holding of the pair of supporting-guiding members at the elevated position by the holding members.

6. An image-forming machine comprising a main body comprised of a lower housing and an upper openable-closable housing mounted on the lower housing for free pivoting between an open position and a closed position about a central pivot axis and a process unit mounted detachably on the main body, the process unit including an image-bearing means having a photosensitive member on its surface, in which:

a main body of the machine further has provided thereon a supporting-guiding means for freely pivoting between an elevated position and a lowered position downwardly from the elevated position about the central pivot axis, a guide portion extending in the mounting direction of the process unit formed on the supporting-guiding means, and when the upper openable-closable housing is held at the open position and the supporting-guiding means is held at the elevated position, the guide portion of the supporting-guiding means extends toward an open space between the lower housing and the upper openable-closable housing, and thus the process unit is detachably mounted on the main body of the machine along the guide portion.

7. The image-forming machine of claim 6 in which the supporting-guiding means is provided with a pair of supporting-guiding members mounted for free pivoting between the elevated position and the lowered position about the central pivot axis as a center, a guide channel extending in the mounting direction of the process unit is defined in each of the pair of supporting-guiding members, a support protrusion is provided in the process unit in correspondence to the guide channel, and by positioning the support protrusion in the guide channel and moving it therealong, the process unit is detachably mounted on the main body of the machine.

8. The image-forming machine of claim 7 in which the process unit includes a developing device for developing a latent electrostatic image formed on the surface of the photosensitive member of the image-bearing means, and is comprised of a first unit on which the developing device is mounted and a second unit on which the image-bearing means is mounted the first unit and the second unit can be mounted on, and detached from, each other, and in mounting the process unit detachably on the main body of the machine, the first unit is mounted on the main body of the machine by the action of the pair of supporting-guiding members, and then the second unit is detachably mounted on the first unit.

9. The image-forming machine of claim 8 in which an elevated position holding means is provided to hold the pair of supporting-guiding members releasably at the elevated position 10. The image-forming machine of claim 9 in which the elevated position holding means includes holding members being pivotable between an operative position at which they act on the pair of supporting-guiding members and hold them at the elevated position and a non-operative position at which they do not substantially act on the pair of supporting-guiding members, and when the first unit is mounted along the pair of supporting-guiding members while the holding members are held at the operative position and the pair of supporting-guiding members are held at the elevated position, part of the first unit acts on the holding members at the operative position and pivots them toward the non-operative position, thereby cancelling of the holding of the pair of supporting-guiding members at the elevated position by the holding members.

11. The image-forming machine of claim 6 in which when the supporting-guiding means is at the elevated position, part of the upper openable-closable housing which pivots the upper openable-closable housing from the open position toward the closed position makes contact with the supporting-guiding means, and thereby making it difficult to hold the upper openable-closable housing at the closed position.

12. An image-forming machine comprising a main body comprised of a lower housing and an upper openable-closable housing mounted for free pivoting between an open position and a closed position and a process unit mounted detachably on the main body, the process unit including an image-bearing means having a photosensitive member on its surface and a developing means for developing a latent electrostatic image formed on the surface of the photosensitive member; in which the process unit is comprised of a first unit on which the developing device is mounted and a second unit on which the image-bearing member is mounted, the first unit and the second unit can be mounted on, and detached from, each other, the second unit further has provided therein a cover means for protecting the surface of the image-bearing means, the shape of the bottom portion of the cover means corresponding to that of part of the lower housing, a guide channel extending in a predetermined direction is defined in the first unit, and in the second unit, a guide protrusion corresponding to the guide channel is provided, and to mount the process unit detachably on the main body of the machine, the first unit is mounted on the main body of the machine, the second unit is then placed on said part of the lower housing, and the first unit is pivoted downwardly whereby the guide protrusion provided in the second unit is detachably received in the guide channel defined in the first unit, and thereafter by moving the guide protrusion along the guide channel, the second unit is held at a predetermined position, and then the cover means is detached from the second unit.

13. The image-forming machine of claim 12 in which the cover means is comprised of a cover member covering the lower portion of the second unit and a protecting sheet part of which is attached to the cover member, and by detaching the cover member from the second unit, the protecting sheet is detached together from the second unit.

14. The image-forming machine of claim 12 in which the second unit is provided with a cleaning device for removing the toner remaining on the surface of the photosensitive member, the cleaning device has an elastic blade capable of moving between an operative position at which it acts on the photosensitive member of the image-bearing means and a non-operative position at which it does not substantially act on said photosensitive member, and while the cover means is mounted on the second unit, the elastic blade is held at the non-operative position, and when the cover means is detached from the second unit, the elastic blade is held at the operative position.

15. An image-forming machine comprising a main body and a unit to be mounted detachably on the main body, said unit including an image-bearing means having a photosensitive member on its surface and a cleaning device for removing the toner remaining on the surface of the photosensitive member, said cleaning device having an elastic blade capable of moving between an operative position at which it acts on the photosensitive member of the image-bearing means and a non-operative position at which it does not substantially act on said photosensitive member; in which the unit further has provided therein a cover means for protecting the photosensitive member of the image-bearing means, and the unit is constructed such that in relation to the cover means, when the cover means is mounted on the unit, the elastic blade is held at the non-operative position, and when the cover means is detached from the unit, the elastic blade is held at the operative position.

16. The image-forming machine of claim 15 in which the elastic blade is secured to a supporting member mounted movably, a biasing means is also provided which biases the supporting member toward the image-bearing means, the cover means is comprised of a cover member covering the lower portion of the unit and a protecting sheet covering the upper portion of the unit, and when the cover means is mounted, part of the cover member comes into engagement with the supporting member thereby to hold the elastic blade at the non-operative position, and when the cover means is detached, the cover member comes out of engagement with the supporting member whereby the elastic blade is held at the operative position by the action of the biasing means.

17. An image-forming machine comprising a rotating drum having a photosensitive member on its surface, in which a shaft portion provided at one end of the rotating drum is supported detachably and rotatably on a receiving means provided in the main body of the machine, and by mounting the rotating drum on the main body of the machine, a driven gear provided at one end portion of the rotating drum is drivingly coupled to a driving coupling gear drivingly coupled to a driving source provided in the main body of the machine; wherein the receiving means for supporting the shaft portion provided at one end of the rotating drum defines a nearly semicircular receiving surface covering part of the upper part of the shaft portion, and a force transmitted from the driving coupling gear to the driven gear at the time of drivingly coupling the driving gear to the driven gear is substantially supported by the receiving surface of the receiving means;

wherein a first end portion of the receiving surface contacts the shaft portion at a site which is above a horizontal line passing through the center of the shaft portion of the rotating drum and which is upstream in a first rotating direction of the rotating drum, another end portion of the receiving surface is provided with an escape portion, whereby, when the rotating drum is rotated in the first direction, a force directed upwardly obliquely toward an upstream side in the rotating direction of the rotating drum acts on the shaft portion of the rotating drum, owing to a force to be transmitted from the driving coupling gear to the driven gear.

18. The image-forming machine of claim 17, wherein after the rotation of the rotating drum in the first direction is stopped, the rotating drum is rotated for a predetermined time in the opposite direction.

19. An image-forming machine comprising a main body and a process unit adapted to be detachably mounted on the main body, in which the process unit includes a unit frame and a rotating drum mounted rotatably on the unit frame, the surface of the rotating drum has disposed thereon a photosensitive member, a driven gear and a shaft portion are provided at one end portion of the rotating drum, the main body of the machine has disposed therein a driving coupling gear drivingly connected to a driving source and a receiving means for supporting the shaft portion of the rotating drum, and when the process unit is mounted on a predetermined position of the main body, the driven gear is drivingly coupled to the driving coupling gear and the shaft position is supported on the receiving means; wherein the receiving means defines a nearly semicircular receiving surface covering part of the upper part of the shaft portion, and a force transmitted from the driving coupling gear to the driven gear during the driving coupling of the driving coupling gear with the driven gear is supported substantially by the receiving surface of the receiving means, wherein a first end portion of the receiving surface contacts the shaft portion at a site which is above a horizontal line passing through the center of the shaft portion of the rotating drum and which is upstream in a first rotating direction of the rotating drum, another end portion of the receiving surface is provided with an escape portion, whereby, when the rotating drum is rotated in the first direction, a force directed upward obliquely toward an upstream side in the rotating direction of the rotating drum acts on the shaft portion of the rotating drum (12), owing to the force which is transmitted from the driving coupling gear to the driven gear.

20. The image-forming machine of claim 18, wherein after the rotation of the rotating drum in the first direction is stopped, the rotating drum is rotated for a predetermined time in the opposite direction.

21. A developing device, comprising:

a magnetic brush mechanism comprised of a hollow cylindrical sleeve holding a developer on its peripheral surface, and a permanent magnet disposed within the sleeve, and a blade for acting on the surface of the sleeve for removing the excess of the developer held on the sleeve, in which the sleeve is moved in a predetermined direction to convey the developer held on the surface of the sleeve toward a developing zone and the amount of the developer fed into the developing zone is controlled by the action of the blade;

wherein before the starting of the developing operation, the sleeve is moved in a direction opposite to the predetermined direction, so as to remove a pool of the developer existing between the surface of the sleeve and a free end portion of the blade.

22. A developing device, comprising:

a magnetic brush mechanism comprised of a hollow cylindrical sleeve holding a developer on its peripheral surface, and a permanent magnet disposed within the sleeve, and a blade for acting on the surface of the sleeve and removing the excess of the developer held on the sleeve, in which the sleeve is moved in a predetermined direction to convey the developer held on the surface of the sleeve toward a developing zone and the amount of the developer fed into the developing zone is controlled by the action of the blade;

wherein after the end of the developing operation, the sleeve is moved in a direction opposite to the predetermined direction, so as to remove a pool of the developer existing between the surface of the sleeve and a free end portion of the blade.

23. A developing device, comprising:

a magnetic brush mechanism comprised of a hollow cylindrical sleeve holding a developer on its peripheral surface, and a permanent magnet disposed within the sleeve, and a blade for acting on the surface of the sleeve and removing the excess of the developer held on the sleeve, in which the permanent magnet is moved in a predetermined direction to convey the developer held on the surface of the sleeve toward a developing zone and the amount of the developer fed into the developing zone is controlled by the action of the blade;

wherein before the starting of the developing operation, the permanent magnet is moved in a direction opposite to the predetermined direction, so as to remove a pool of the developer existing between the surface of the sleeve and a free end portion of the blade.

24. A developing device, comprising:

a magnetic brush mechanism comprised of a hollow cylindrical sleeve holding a developer on its peripheral surface, and a permanent magnet disposed within the sleeve, and a blade for acting on the surface of the sleeve and removing the excess of the developer held on the sleeve, in which the permanent magnet is moved in a predetermined direction to convey the developer held on the surface of the sleeve toward a developing zone and the amount of the developer fed into the developing zone is controlled by the action of the blade;

wherein after the end of the developing operation, the permanent magnet is moved in a direction opposite to the predetermined direction, so as to remove a pool of the developer existing between the surface of the sleeve and a free end portion of the blade.

* * * * *